US005706679A

United States Patent [19]

Zane et al.

[11] Patent Number: 5,706,679

[45] Date of Patent: Jan. 13, 1998

[54] HARNESS FOR SECURING A VEHICLE

[75] Inventors: Michael S. Zane, Brookline; Cornelius McDaid, Dorchester, both of Mass.

[73] Assignee: Kryptonite Corporation, Canton, Mass.

[21] Appl. No.: 494,336

[22] Filed: Jun. 26, 1995

[51] Int. Cl.[6] ..... E05B 71/00

[52] U.S. Cl. ..... 70/18; 70/49; 70/51; 70/55; 70/58; 70/233

[58] Field of Search ..... 70/14, DIG. 12, 70/225–227, 233, 18, 30, 49, 51–56, 58

[56] References Cited

U.S. PATENT DOCUMENTS

| | | | |
|---|---|---|---|
| D. 289,491 | 4/1987 | Johnson | D8/330 |
| 1,036,992 | 8/1912 | Franki . | |
| 1,364,539 | 1/1921 | Baker et al. . | |
| 1,448,658 | 3/1923 | Furber . | |
| 1,571,057 | 1/1926 | Kroll | 70/54 |
| 3,084,532 | 4/1963 | Williams | 70/63 |
| 3,245,239 | 4/1966 | Zaidener | 70/202 |
| 3,462,982 | 8/1969 | Moore | 70/209 |
| 3,664,164 | 5/1972 | Zaidener | 70/202 |
| 3,742,743 | 7/1973 | Stoyanovitch | 70/209 |
| 3,808,847 | 5/1974 | Vesely | 70/56 X |
| 4,028,916 | 6/1977 | Pender | 70/49 X |
| 4,103,524 | 8/1978 | Mitchell et al. | 70/209 |
| 4,129,921 | 12/1978 | Greene | 16/38 |
| 4,155,231 | 5/1979 | Zane et al. | 70/18 |
| 4,157,602 | 6/1979 | Pennell | 70/18 X |
| 4,304,110 | 12/1981 | Fain | 70/209 |
| 4,317,344 | 3/1982 | Barnard | 70/55 |
| 4,719,773 | 1/1988 | Alberts | 70/18 |
| 4,733,840 | 3/1988 | D'Amore | 70/18 X |
| 4,738,127 | 4/1988 | Johnson | 70/209 |
| 4,831,849 | 5/1989 | Kortenbrede | 70/417 X |
| 4,848,110 | 7/1989 | Kuo | 70/38 C |
| 4,850,207 | 7/1989 | Ylven | 70/49 |
| 4,986,095 | 1/1991 | Chou et al. | 70/18 |
| 4,987,753 | 1/1991 | Kuo | 70/39 |
| 5,010,746 | 4/1991 | Zane et al. | 70/39 |
| 5,035,126 | 7/1991 | Biba | 70/18 |
| 5,070,713 | 12/1991 | Chen | 70/38 B |
| 5,092,146 | 3/1992 | Wang | 70/209 |
| 5,092,192 | 3/1992 | Zane et al. | 70/39 |
| 5,107,692 | 4/1992 | Chen | 70/209 |
| 5,138,853 | 8/1992 | Chen | 70/209 |
| 5,157,951 | 10/1992 | Chen et al. | 70/209 |
| 5,179,849 | 1/1993 | Wang | 70/209 |
| 5,219,384 | 6/1993 | Elsfelder et al. | 70/18 |
| 5,265,451 | 11/1993 | Phifer | 70/226 |
| 5,505,064 | 4/1996 | Wang | 70/53 |

*Primary Examiner*—Lloyd A. Gall
*Attorney, Agent, or Firm*—Morse, Altman & Benson

[57] ABSTRACT

A harness for securing more than one part of a vehicle to a station comprising a tether and a U-lock. The U-lock includes a tubular body and a solid shackle. The body has a pair of aligned holes in the wall and a locking mechanism. The shackle is a U-shaped, solid rod, where one leg has a bent foot that fits into one aligned hole and the other leg has a shaped foot adapted to be captured by the locking mechanism after being inserted into the other aligned hole. The tether includes a length of flexible material and a cuff. The length is a braided cable or a chain, and is sheathed. A hardened steel cuff is rotatably connected to the one end of the length. The cuff has a number of configurations of openings through which components of the U-lock are inserted before the U-lock is assembled. A loop is connected to the other end of the length and is sized to permit the cuff, but not the U-lock, to pass through.

43 Claims, 24 Drawing Sheets

HARNESS FOR SECURING A VEHICLE

BACKGROUND OF THE INVENTION

1. Field of the Invention

The present invention relates to portable locks, and, more particularly, to heavy-duty portable locks that are highly resistant to physical assault by bolt cutters, crowbars, hack saws and the like, and that are flexible.

2. The Prior Art

There have been two basic forms of portable locks for bicycles, motorcycles, and the like: (1) the cable or chain lock and (2) the U-lock. Each of these locks has its advantages and disadvantages.

The cable lock is typically a length of braided steel cable with a mechanism for connecting the ends together to form a closed loop. The chain lock typically is a length of chain made of links of a hard substance, such as steel, with a mechanism for connecting the ends together to form a closed loop. Cable and chain locks have two major advantages, length and flexibility. The chain or cable can be made into any length necessary for its designed task and the quality of the security afforded by the lock typically is not affected by the length. For example, a lock with a length of 2 feet would be as easy to cut apart as a lock with a length of 3 feet. The flexibility of the cable allows the lock to be deformed when necessary for use. Flexibility also permits the lock to be made with the longest length that is foreseeably necessary, since the unused portion of the cable or chain can be coiled up.

One disadvantage to the cable and chain locks is the manner in which the ends are typically joined to form a closed loop. There are two general methods, a separate padlock and an integral lock. The separate padlock is used to join together either two links of the chain or two loops formed in the ends of the cable. Its main drawback is that the shackle of the typical padlock is made of a relatively small diameter rod. Such a rod can be sawed through in a relatively short period of time or can be broken with a moderate amount of force by using, for example, a crowbar. The typical integral lock has two components that project axially from the ends of the cable, where one component inserts into the side of the other. The locking mechanism projects outwardly, making it relatively easy to snap off by using a long pipe fitted over the projection for leverage, thereby defeating the lock.

Another disadvantage of the cable and chain locks is the fact that there is only one loop formed by the cable or chain, regardless of the number of twists and turns it makes while snaking through various vehicle parts. This means that all the parts of the vehicle are secured to the same degree. If the lock is broken, there are no parts of the vehicle that remain secured.

The U-lock typically includes a U-shaped shackle and a tubular body with an internal locking mechanism. One example of a U-lock is illustrated in U.S. Pat. No. 4,155,231, issued May 22, 1979, in the names of Michael S. Zane and Peter L. Zane, for Bicycle Lock and Bracket. The main advantage of the U-lock is the security that it affords, which is well established. The main drawbacks are its length and flexibility. The U-lock is necessarily made with a rigid shackle. As such, it must be relatively short or it becomes very inconvenient to use, carry, and store. Its rigidity relegates it to use in limited situations, and it cannot, in most instances, be used to secure more than one part of the vehicle, for example, only the front or rear wheel, but not both. For example, when one wheel of a bicycle is secured to an immovable station by a U-lock, the other wheel of the bicycle may be readily stolen.

Therefore, there continues to be a need for a portable lock that simultaneously has the security afforded by the U-lock and the length and flexibility afforded by the chain and cable locks.

BRIEF SUMMARY OF THE INVENTION

The primary object of the present invention is to provide a device for combining the advantages of both the cable and chain locks and the U-lock.

The present invention contemplates a combination of a flexible tether and a U-lock to form a harness for securing more than one part of a vehicle to a station.

More particularly, the harness of the present invention includes: (a) a U-lock including as components a cross-piece and a shackle; (b) the cross-piece being tubular and having aligned shackle openings in its wall, where the axes of the openings are parallel; (c) the shackle having a pair of substantially parallel legs with feet that are adapted to be received simultaneously by the shackle openings; (d) a lock mechanism in the cross-piece for securing the feet in the shackle openings when received thereby; (e) a tether including as components a length of elongated flexible aggregation, a loop, and a cuff; (f) the loop being secured to the first end of the length; (g) the cuff being secured to the second end of the length by a cuff securing means; (h) the cuff providing at least one opening adapted to receive at least one of the components of the U-lock; and (i) the U-lock being secured to the cuff when one of the components of the U-lock is received in one of the openings of the cuff and the feet are received in the shackle openings and secured by the lock mechanism.

Preferably, the U-lock includes a tubular body and a solid shackle. The body has a pair of longitudinally aligned holes through the wall and an internal locking mechanism. The shackle is substantially U-shaped, where one leg has a bent foot that fits into the first body hole and the other leg has a shaped foot that is adapted to be captured by a locking mechanism after being inserted into the second body hole.

The tether includes a length of flexible material, a cuff, and a loop. In one preferred embodiment, the length of flexible material is a braided cable. The cable can be composed of any material or combination of materials suitable to a vehicle lock, such as a metal alloy, tough composite, or a combination thereof. In one configuration, the cable is composed of braided hardened steel wires. In another configuration, the cable is a braid of KEVLAR® filaments and hardened steel wires. In a third configuration, the cable is a set of hardened steel wires braided around a hemp rope core. The cable is sheathed in order to protect the vehicle being secured. In one embodiment, the sheathing is a solid vinyl. In another embodiment, the sheathing is a nylon or polypropylene mesh. The loop is formed in one end of the cable by curling the end segment of the cable back and permanently joining it to an inner segment of the cable with an aluminum yoke. The inside area of the loop is large enough for the cuff to pass through but too small for the U-lock-cuff combination to pass through. To close the harness, either the cuff is inserted through the loop and the U-lock is assembled to the cuff as described below, or the shackle or body of the U-lock is inserted through the loop and the U-lock is assembled to the cuff as described below.

In an alternate preferred embodiment, the length of flexible material is a link chain. Preferably, the links are composed of hardened steel, but can be composed of any material suitable to a vehicle lock, such as a metal alloy or a tough composite. The cable is sheathed in order to protect the vehicle being secured. In one embodiment, the sheathing is a solid vinyl. In another embodiment, the sheathing is a nylon or polypropylene mesh. The loop is the link at the end of the chain. In one embodiment, the loop is a link that is the same size and shape as the other links. To close the harness, the shackle of the U-lock is inserted through that end link before assembling the U-lock to the cuff as described below. In another embodiment, the last link is large enough for the cuff to pass through but too small for the U-lock-cuff combination to pass through. To close the harness, either the cuff is inserted through the link and the U-lock is assembled to the cuff as described below, or the shackle or body of the U-lock is inserted through the link and the U-lock is assembled to the cuff as described below.

Preferably, the cuff is a hardened steel, cylindrical device that tapers slightly over about one half its length. Common to all five below-described embodiments of the cuff, the length of flexible material is rotatably connected to the cuff such that the length and the cuff are axially aligned and rotate relative to each other on that axis. For the cable material, the connection is accomplished by a collar crimped to one end of the length and a receptacle formed in the narrow end of the cuff that is adapted to permanently retain the collar. For the chain material, the connection is accomplished by a collar attached to the other end link and a receptacle formed in the narrow end of the cuff that is adapted to permanently retain the collar.

In the first cuff embodiment, the cuff has a socket at the wide end that is slightly larger than the outer diameter of the U-lock body and a port through the wall of the cuff that meets the socket and that is slightly larger than the diameter of the shackle. The body of the U-lock is inserted into the socket and the shackle is assembled with the body through the port. In the second embodiment, the cuff has a socket at the wide end that is slightly larger than the outer diameter of the U-lock body and a pair of axially aligned ports through the wall of the cuff that meet the socket and that are slightly larger than the diameter of the shackle. To assemble, either the body of the U-lock is inserted into the socket and the shackle is assembled with the body through one of the ports or one leg of the shackle is inserted through both ports and the U-lock is assembled. In the third embodiment, the cuff has a hole through the cuff near the wide end that is slightly larger than the diameter of the shackle. One leg of the shackle is inserted through the hole and the U-lock is assembled. In the fourth embodiment, the cuff has a socket at the wide end that is slightly larger than the diameter of the U-lock shackle and a pair of axially aligned ports through the wall of the cuff that meet the socket and that are slightly larger than the outside diameter of the U-lock body. To assemble, either the body of the U-lock is inserted into one of the ports and the shackle is assembled with the body through the socket or the body is inserted through both ports and the U-lock is assembled. In the fifth embodiment, the cuff has a hole through the cuff near the wide end that is slightly larger than the outside diameter of the U-lock body. The body is inserted through the hole and the U-lock is assembled.

Thus, combining the tether and the U-lock into a harness takes advantage of (1) the length and flexibility of a cable or chain lock, and (2) the security afforded by a U-lock. In addition, because the harness has two separate security loops, one by the tether and the other by the U-lock, multiple parts of the vehicle can be secured to each other and to an immovable station.

Other objects of the present invention will in part be obvious and will in part appear hereinafter.

BRIEF DESCRIPTION OF THE DRAWINGS

For a fuller understanding of the nature and objects of the present invention, reference is made to the following specification, which is to be taken in connection with the accompanying drawings, wherein.

DETAILED DESCRIPTION

Figure 1:
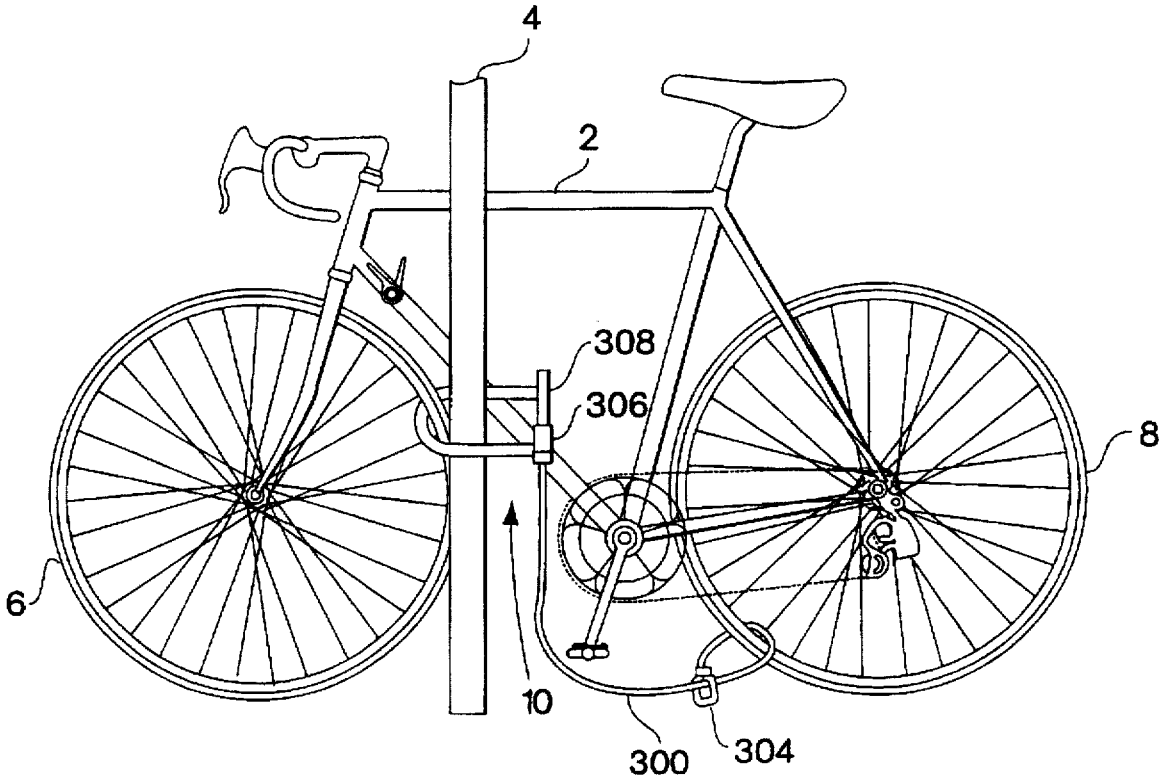
FIG. 1 is a perspective view of one embodiment of the present invention in use.

The Harness of FIG. 1

The harness 10 of the present invention is shown in FIG. 1 as securing a bicycle 2 to an immovable station 4. The harness 10 includes a U-lock 308 and a tether 300. The tether 300 is snaked through various parts of the bicycle, for example, the rear wheel 8, and the cuff 306 is inserted through the loop 304, creating a lasso around the rear wheel 8. The U-lock 308 is assembled to the cuff 306, around the front wheel 6 and station 4 in order to secure those parts, and by extension, the bicycle 2, to the station 4.

Figure 2:
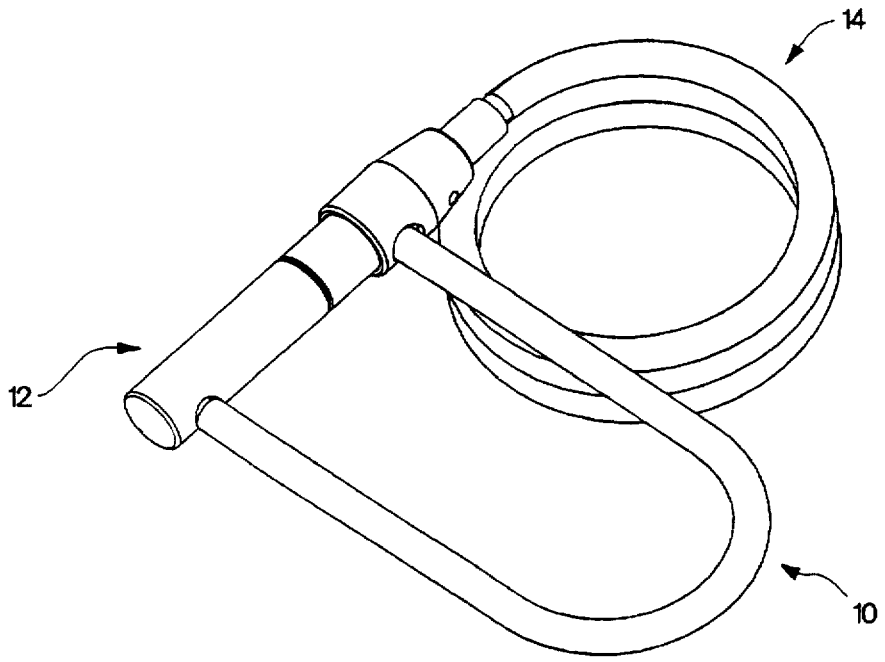
FIG. 2 is a perspective view of one embodiment of the present invention assembled.
Figure 3:
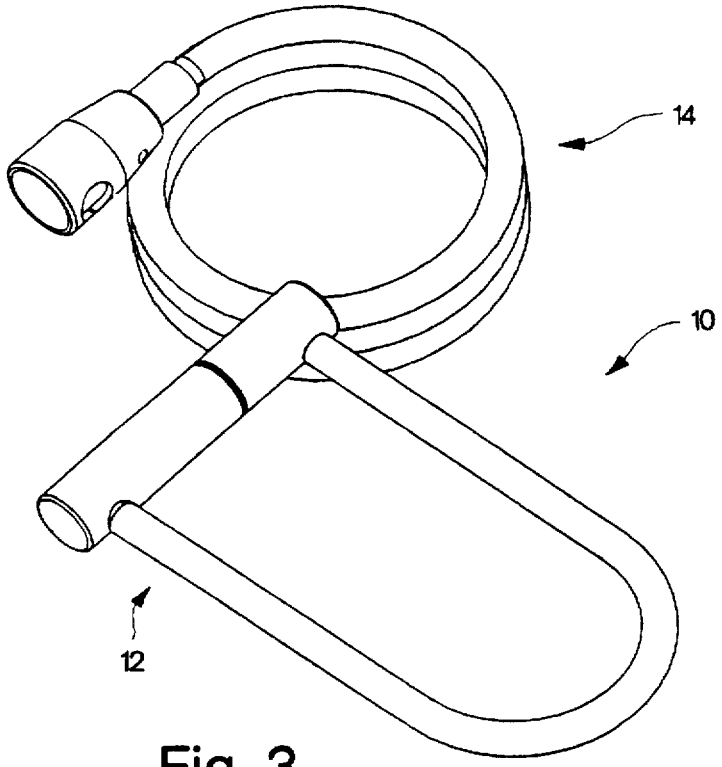
FIG. 3 is a perspective view of the embodiment of FIG. 1 in partial disassembly.

The Harness of FIGS. 2 and 3

The present invention contemplates a variety of harness configurations. The embodiment of the harness of the present invention includes a U-lock 12 and flexible tether 14. One such harness 10 is shown in FIGS. 2 and 3. FIG. 2 shows the harness 10 as a complete assembly and FIG. 3 shows the harness 10 in its normal disassembled state. The various configurations result from different embodiments of the tether 14 and the configurations are described below with descriptions of the different embodiments of the tether 14.

The U-Lock of FIGS. 4 to 21

Figure 4:
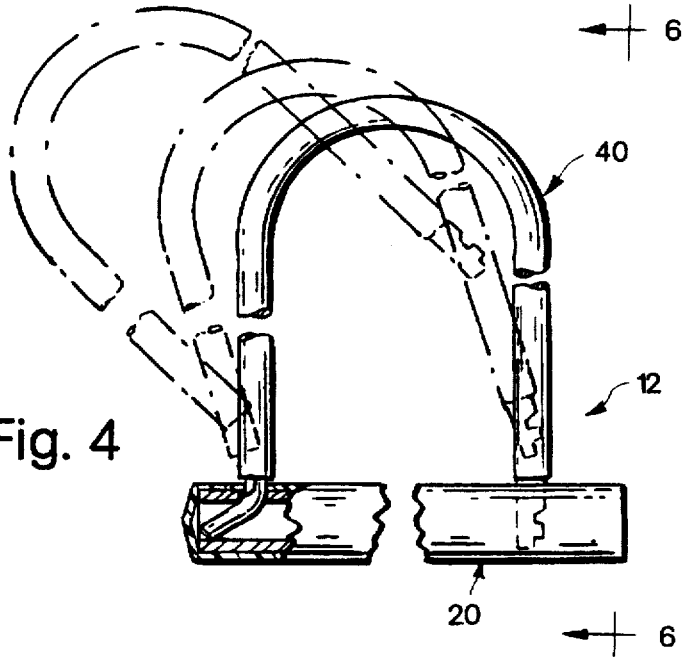
FIG. 4 is a front view of a typical U-lock.
Figure 5:
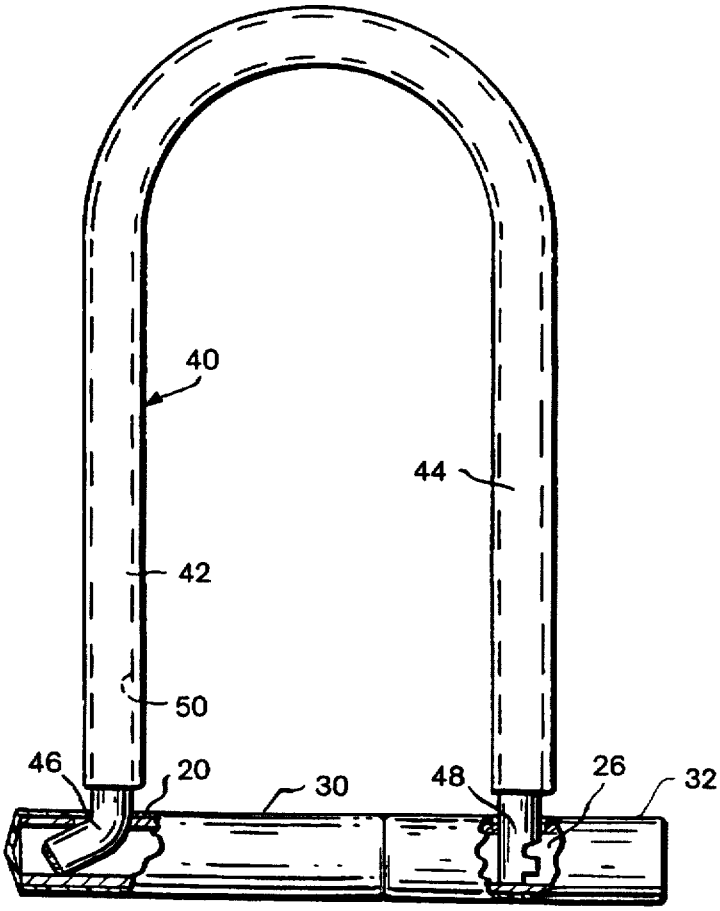
FIG. 5 is a broken-away view of the U-lock of FIG. 4, partly in cross-section.
Figure 6:
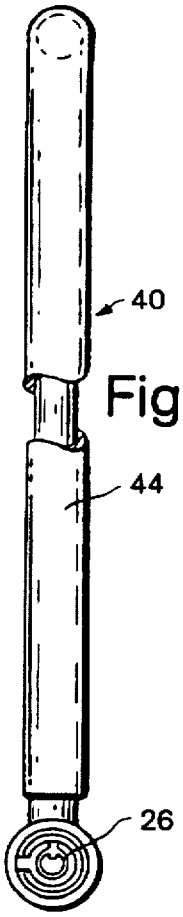
FIG. 6 is a side view of the U-lock of FIG. 4.
Figure 7:
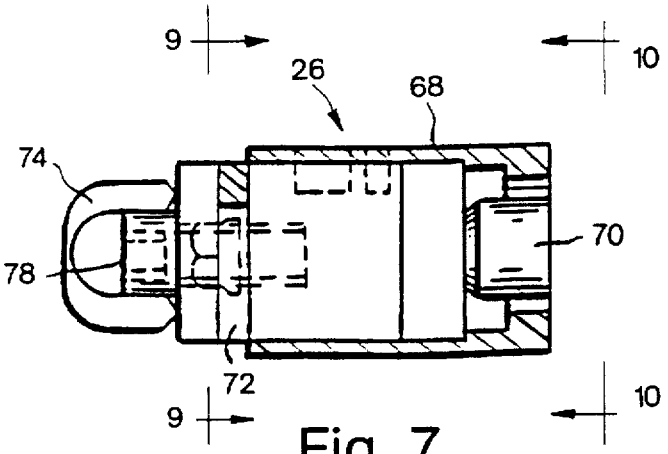
FIG. 7 is a cross-sectional front view of components of the locking mechanism of the U-lock of FIG. 4.
Figure 8:
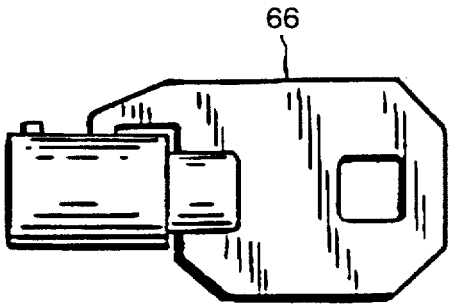
FIG. 8 is a front view of the key for the U-lock of FIG. 4.
Figure 9:
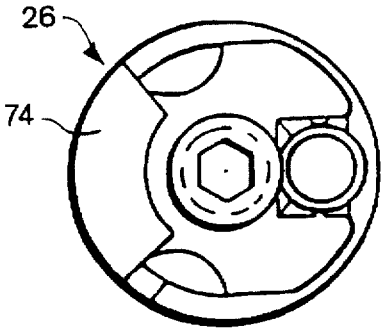
FIG. 9 is a view of the locking mechanism of FIG. 7 taken along the line 9—9.
Figure 10:
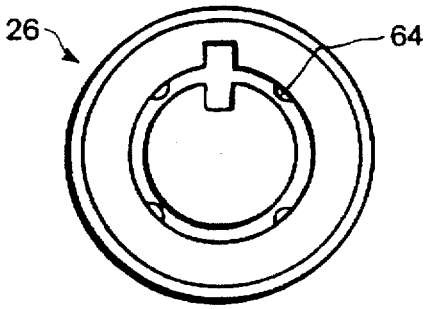
FIG. 10 is a view of the locking mechanism of FIG. 7 taken along the line 10—10.
Figure 11:
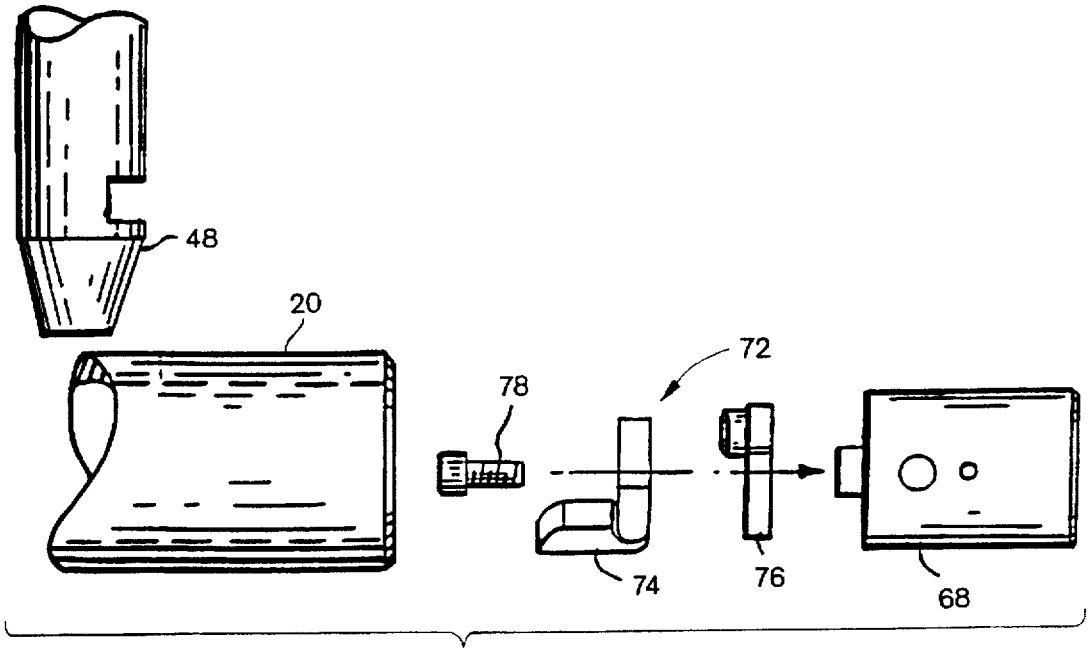
FIG. 11 is an exploded front plan view of components of the locking mechanism of FIG. 10.

FIGS. 4 to 6 illustrate the basic U-lock 12. Generally, the U-lock 12 is of the type used to anchor a bicycle or motorcycle to a fixed station. In the preferred embodiment, the U-lock 12 includes a body 20 having a hardened steel tubular construction with a pair of longitudinally aligned spaced openings 22, 24, a security mechanism 26 accessible from outside the body 20, and a shackle 40 having a hardened steel rod construction with a pair of opposed legs 42, 44. One of the shackle legs 42 has a bent foot 46 which is free for swivelling and rocking in one of the openings 22 when the U-lock is open and the other of the legs 44 has a shaped foot 48 which projects through the other of the openings 24 and is engaged by a catch 74 when the U-lock 12 is closed. Preferably, the body 20 and the shackle 40 are encased in vinyl sleeves 28, 50.

Preferably, body 20 and shackle 40 are fabricated from a heat treated, high grade, hardened steel, and are sufficiently sturdy and thick to present effective resistance to the action of a bolt cutter, hacksaw, or crowbar. Body 20 preferably is of hollow tubular construction that has a circular cross-section, while shackle 40 preferably is of solid cylindrical rod stock construction. Alternatively, the body 20 can be formed of hollow tubular constructions that, in cross-section, are rectangular, oval, pentagonal, hexagonal, octagonal, etc.

Plastic, e.g. vinyl, sheaths 28, 50 preferably enclose the body 20 and the shackle 40 to protect the finished surfaces of the bicycle and motorcycle from being scratched when the harness 10 is applied. Preferably, the body sheath 28 is formed from two parts 30, 32 that are slidably fitted over the opposite ends of the body 20 and that mate at a convenient location along the body 20. At their junction, the two parts 30, 32 can be secured to each other, for example, by welding or gluing the abutting ends.

The security mechanism 26, shown in FIGS. 7 to 11, includes a barrel 68 which is press fitted into the end of the body 20, an inner bushing and sleeve assembly 70 that is rotatable within the barrel 68, a standard cam 72 which includes a catch 74 that engages with and disengages from the shaped foot 48, a stop cam 76 that limits rotation of the assembly 70 within the barrel 68, a socket head cap screw 78 by which the entire assembly is united, and a key 66 with coded serrations that correspond to coded serrations 64 on the assembly 70.

Figure 12:
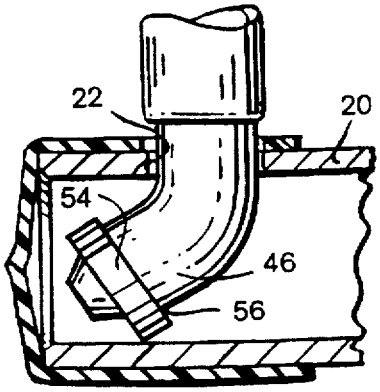
FIG. 12 is an enlarged view illustrating one embodiment of the retainer of the U-lock of FIG. 4, partly broken-away and partly in cross-section.
Figure 13:
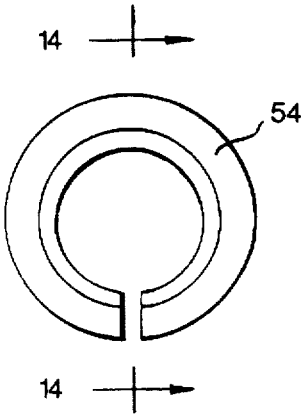
FIG. 13 is a front plan view of the retainer of FIG. 12.
Figure 14:
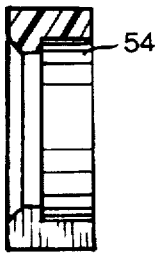
FIG. 14 is a cross-sectional view of the part of FIG. 12, taken along the line 14—14.

An alternate embodiment of the U-lock is shown in FIGS. 12 to 16. The difference from the first embodiment of FIGS. 4 to 6 is the addition of a retainer 54, 58 on the bent foot 46 that normally prevents removal of that foot 46 from the opening 22 during the swivelling and rocking motions of the shackle 40. One form of retainer is shown in FIGS. 12 to 14 as a plastic spring clip 54 which is snugly seated in a peripheral groove 56 that is in contiguity with the free end of bent foot 46. The normal outside diameter of the plastic spring clip 54 is greater than the diameter of opening 22. Preferably, the plastic spring clip 54 is composed of an acetal resin.

Figure 15:
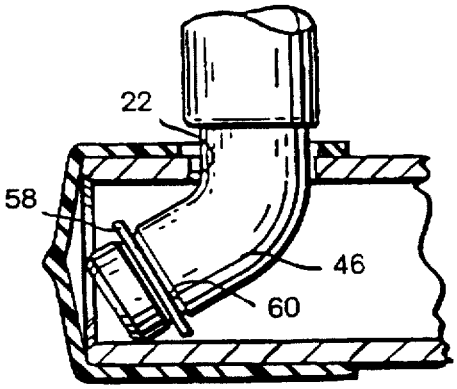
FIG. 15 is an enlarged view illustrating another embodiment of the retainer of the U-lock of FIG. 4, partly broken-away and partly in cross-section.
Figure 16:
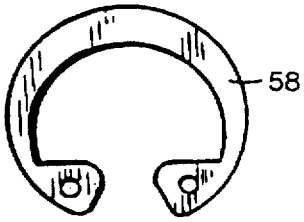
FIG. 16 is a front plan view of the retainer of FIG. 15.
Figure 17:
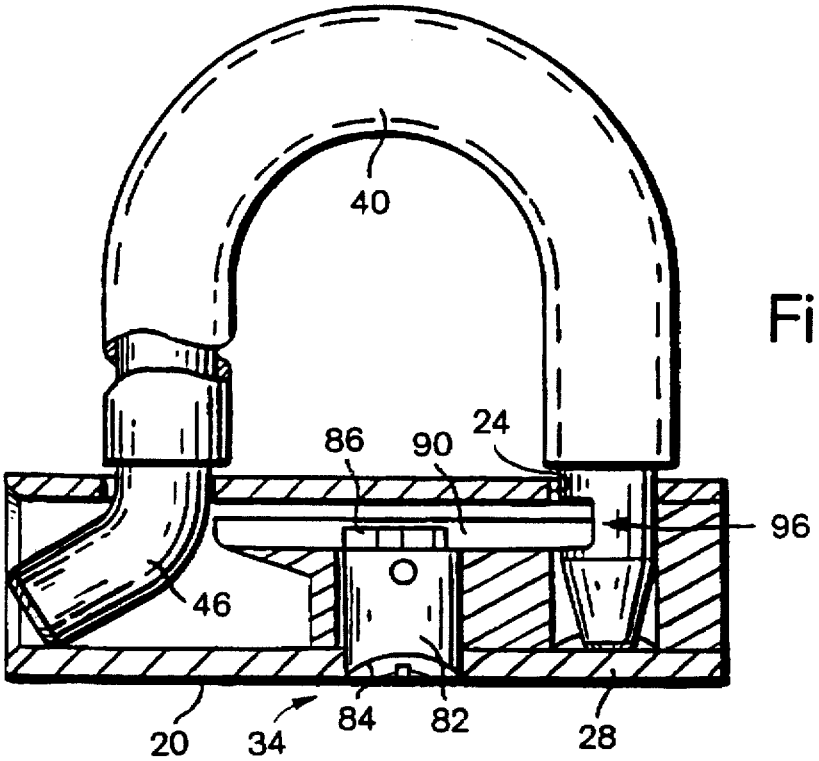
FIG. 17 is a broken-away view of another typical U-lock, partly in cross-section.
Figure 18:
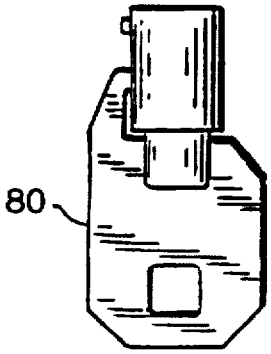
FIG. 18 is a front view of the key for the U-lock of FIG. 17.
Figure 19:
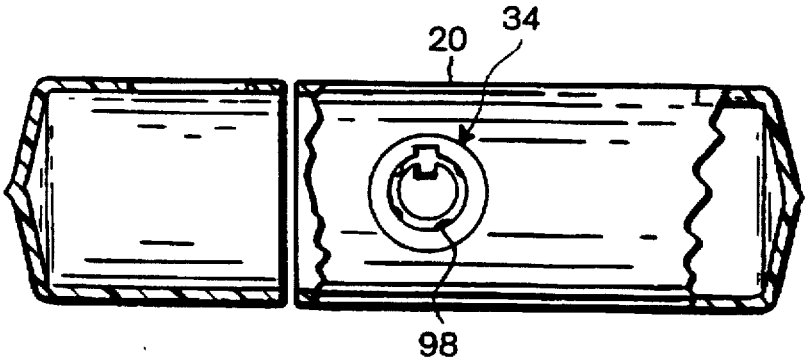
FIG. 19 is a bottom plan view of the U-lock of FIG. 17.
Figure 20:
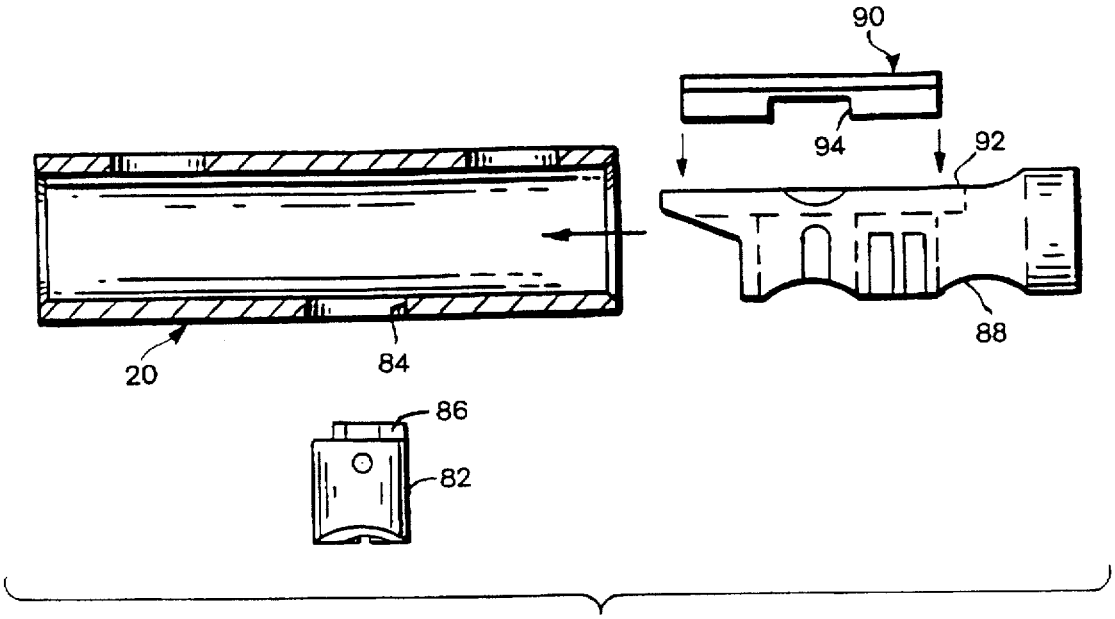
FIG. 20 is an exploded front plan view of components of the locking mechanism of the U-lock of FIG. 17.
Figure 21:
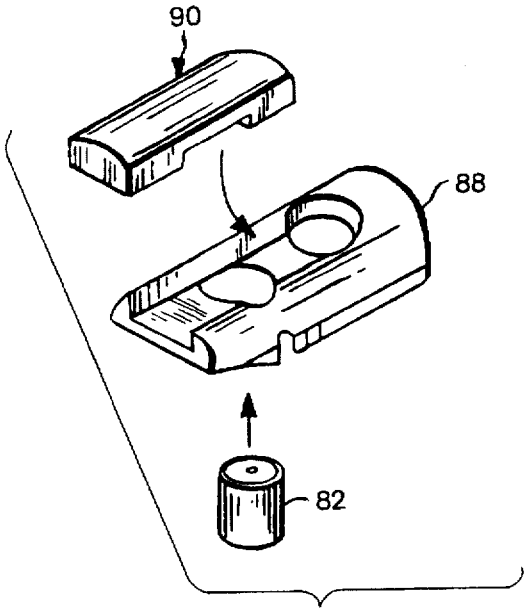
FIG. 21 is an exploded perspective view of components of the locking mechanism of the U-lock of FIG. 17.

Another form of retainer is shown in FIGS. 15 and 16 as a steel spring clip 58 which is snugly seated in a peripheral groove 60 in contiguity with the free end of the bent foot 46. The normal outside diameter of the steel spring clip 58 is greater than the diameter of opening 22. Preferably, the steel spring clip 58 is composed of spring steel.

Another embodiment of the U-lock is shown in FIGS. 17 to 21. The difference from the first embodiment of FIGS. 4 to 6 is the placement of the security mechanism 34 within the body 20. The security mechanism 34 includes a cylinder 82 that is friction-fitted into an opening 84 in body 20, a cam 86 that is eccentrically journaled for rotation about the axis of cylinder 82 under the control of a key 80, a housing 88 that is fixed within the body 20, and a bolt 90 that rides in a channel 92 provided by the housing 88. The cam 86 rides in a channel 94 at the underside of bolt 90, which is reciprocable under the control of the cam 86.

The Tether of FIGS. 22 to 44

The tether 14 is composed of a cuff 16 and a length of flexible material 18. The tether 14 has a variety of embodiments, one of which is shown in FIGS. 2 and 3. The embodiments are based upon different embodiments of the flexible material 18 and the cuff 16.

1.0 The Flexible Material of FIGS. 22 to 26

In general, the flexible material 18 can be any material that the prospective thief cannot break with the tools currently in his possession. There are, however, two preferred embodiments of the flexible material 18, a cable and a chain.

Figure 22:
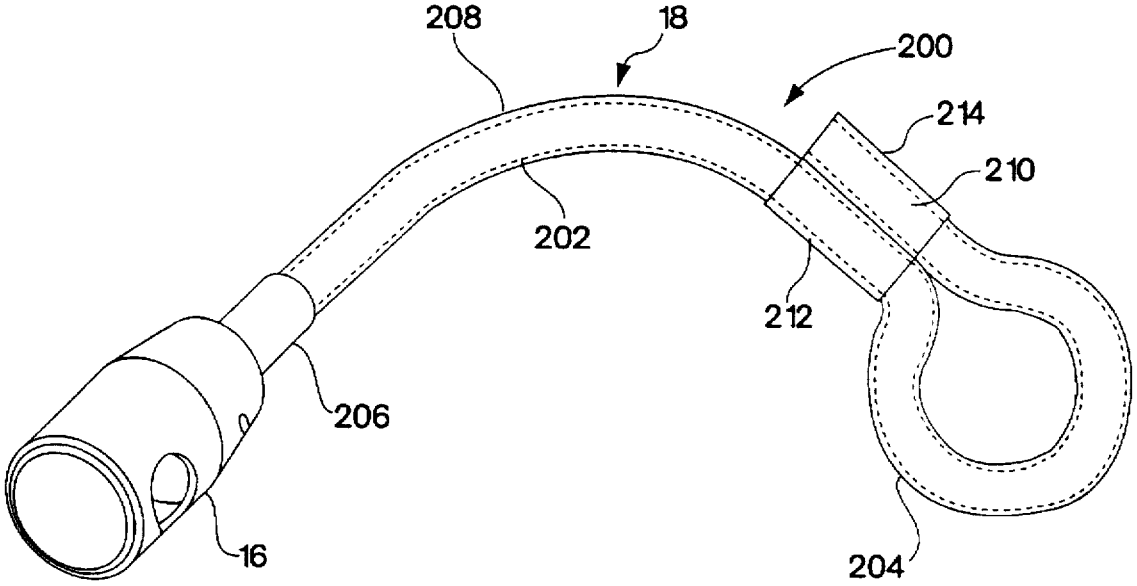
FIG. 22 is a perspective view of a cable embodiment of the present invention.
Figure 23:
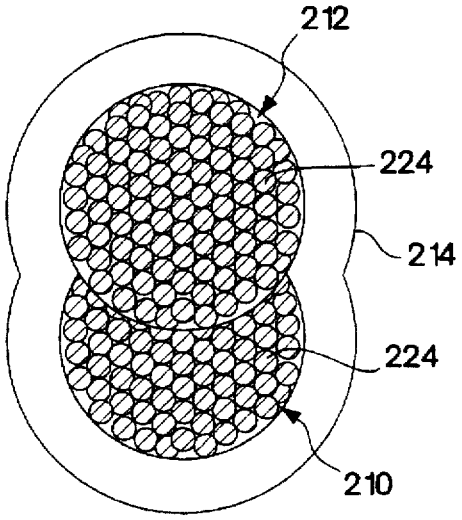
FIG. 23 is a cross-sectional view of a portion of the cable of FIG. 22.
Figure 24:
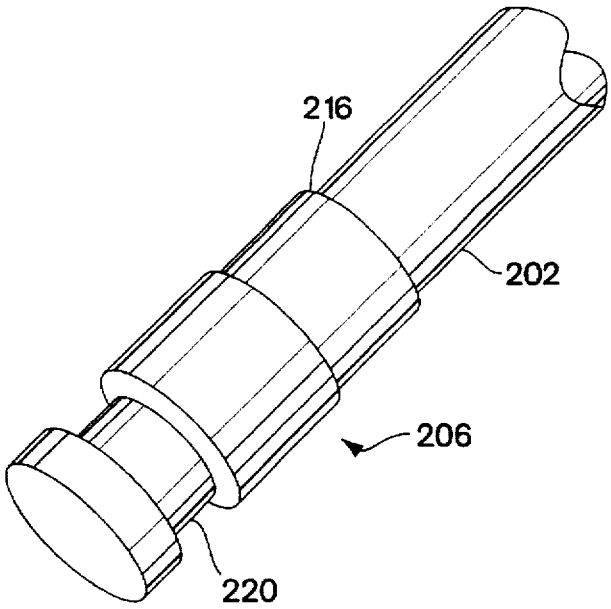
FIG. 24 is a perspective view of a portion of the cable of FIG. 22.

1.1 The Cable Material of FIGS. 22 to 24

The basic embodiment of the tether 14 where the flexible material 18 is a cable is shown in FIG. 22. The preferred cable 200 includes a braid 202, a loop 204, a collar 206, and a sheath 208. The braid 202 is preferably composed of a plurality of intertwined, small gauge filaments 224. The filaments 224 are preferably composed of any material suitable to a vehicle lock, for example, hardened steel, a metal alloy, a tough composite such as KEVLAR®, or a combination thereof. Several constructions for the braid 202 are contemplated. It can be constructed of a single layer, for example, KEVLAR® and hardened steel filaments intertwined throughout the diameter of the braid. The braid 202 can also be constructed in multiple discrete layers, for example, an inner layer of braided hemp rope and an outer layer of braided hardened steel filaments. Any of the layers can be any combination of the materials described above.

The loop 204 is formed at one end of the cable 200 by curling one end segment of the braid 210 back until it is parallel to and contiguous with an inner segment of the braid 212. As in FIG. 23, an aluminum yoke 214 encompasses the contiguous segments of braid 210, 212 and is compressed under high pressure to form a permanent connection. The loop 204 is large enough for the cuff 16 to pass through but small enough so that an assembled cuff-U-lock combination cannot pass through.

As in FIG. 24, the collar 206 is attached to the other end of the braid 202. The collar 206 is a substantially cylindrical solid with a diameter of about 0.08 inches. The collar 206 has a bore 216 that extends axially into one end for about half the length of the collar 206. The diameter of the bore 216 is slightly larger than the outside diameter of the braid 202. The collar 206 is attached to the braid 202 by inserting the other end of the braid 202 into the bore 216 and compressing the outer surface of the collar 206 surrounding the bore 216 under high pressure to form a permanent connection. There is an annular channel 220 in the surface of the solid portion of the collar 206. The purpose of the channel 220 is described below as it relates to how the cable 200 is attached to the cuff 16.

Figure 53:
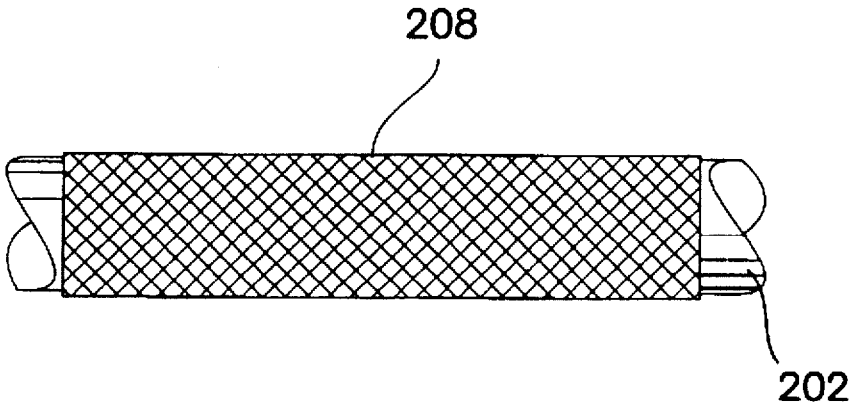
FIG. 53 is a perspective view of a mesh sheath.

Surrounding the exposed portions of the braid 202 is a sheath 208. The sheath 208 is composed of a material that protects the finished surfaces of the vehicle from being scratched when using the harness 10. In one embodiment, the sheath 208 is composed of a soft plastic, such as vinyl. In another embodiment, the sheath 208 is composed of a material harder than vinyl, such as nylon or polypropylene, that is woven into a flexible cylindrical mesh, as shown in FIG. 53. The mesh structure allows the cable extensive flexibility when sheathed, and the harder nylon or polypropylene material gives the sheath 208 a much better wearability than the softer vinyl.

Figure 25:
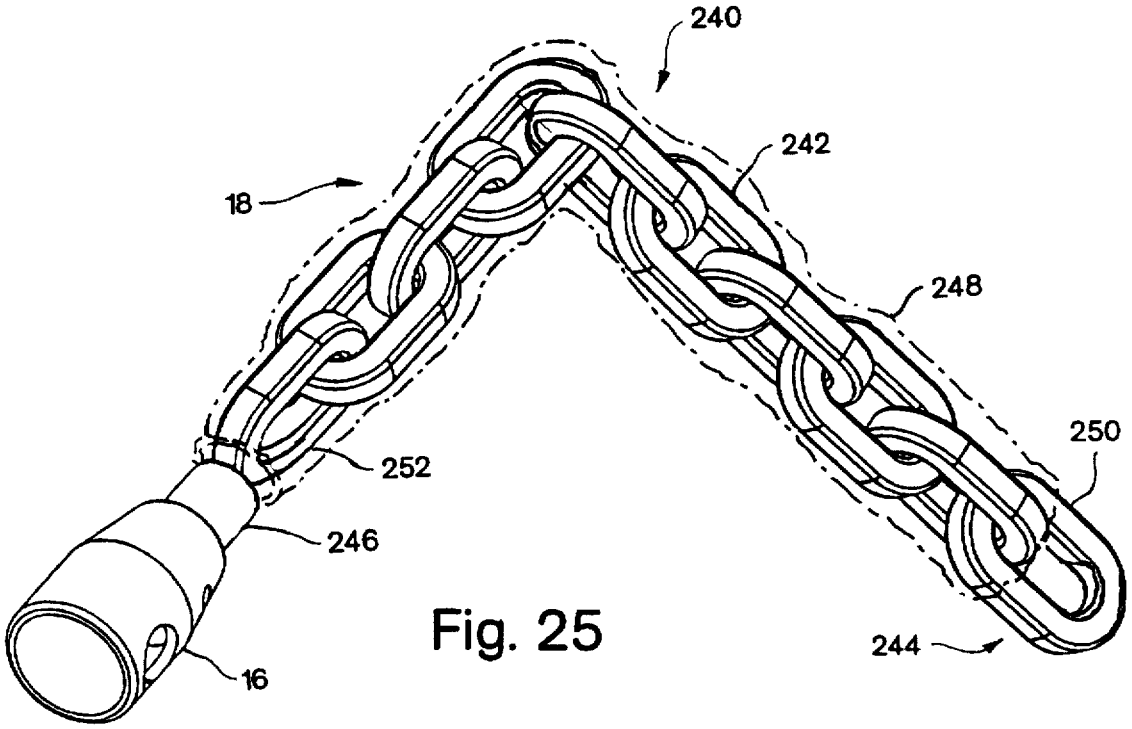
FIG. 25 is a perspective view of a chain embodiment of the present invention.
Figure 26:
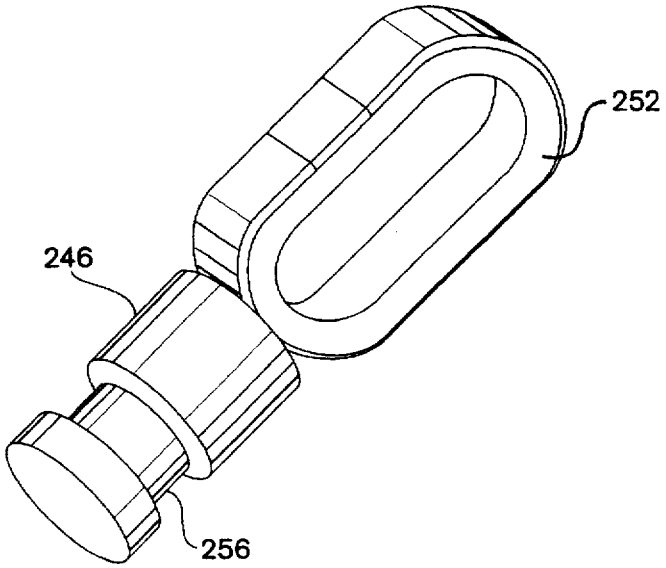
FIG. 26 is a perspective view of a portion of the cable of FIG. 25.
Figure 27:
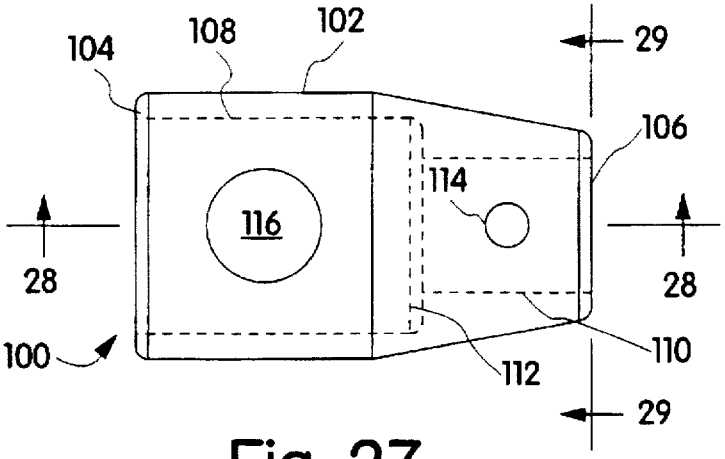
FIG. 27 is a top plan view of the first embodiment of the cuff of the present invention.
Figure 28:
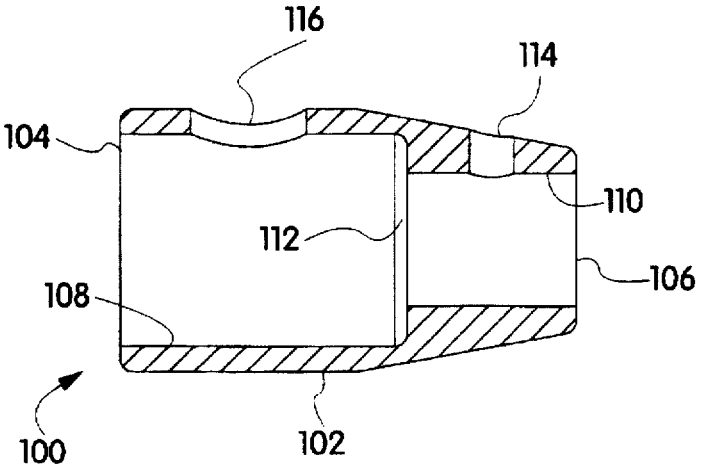
FIG. 28 is a cross-section of the cuff of FIG. 27 taken along the line 28—28.
Figure 29:
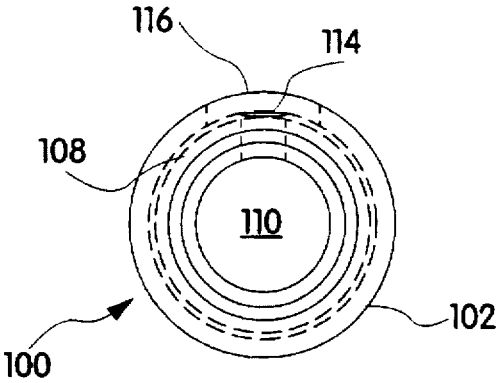
FIG. 29 is a side plan view of the cuff of FIG. 27 taken along the line 29—29.

1.2 The Chain Material of FIGS. 25 and 26

The basic embodiment of the tether 14 where the flexible material 18 is a chain is shown in FIG. 25. The preferred chain 240 includes a plurality of links 242, a loop 244, a collar 246, and a sheath 248. The links 242 are preferably composed of hardened steel. They can, however, be composed of any material suitable to a vehicle lock, such as a metal alloy or tough composite. The links 242 are intertwined, where each link 242 is intertwined with two other links, with the exception of the two end links 250, 252. In one embodiment, the loop 244 is one of the normal end links 250. In another embodiment, the loop 244 is a special end link large enough for the cuff 16 to pass through but small enough so that an assembled cuff-U-lock combination cannot pass through.

As in FIG. 26, the collar 246 is attached to the other end of the chain 240. The collar 246 is a substantially cylindrical solid with a diameter of about 0.08 inches. The collar 246 is permanently connected to the other end link 252 of the chain 240, for example, by welding. There is an annular channel 256 in the surface of the solid portion of the collar 246. The purpose of the channel 256 is described below as it relates to how the chain 240 is attached to the cuff 16.

Surrounding a majority of the exposed portions of the links 242 is a sheath 248. The sheath 248 is composed of a material that protects the finished surfaces of the vehicle from being scratched when using the harness 10. In one embodiment, the sheath 248 is composed of a soft plastic, such as vinyl. In another embodiment, the sheath 248 is composed of a material harder than vinyl, such as nylon or polypropylene, that is woven into a flexible cylindrical mesh. The mesh structure allows the cable extensive flexibility when sheathed, and the harder nylon or polypropylene material gives the sheath 248 a much better wearability than the softer vinyl.

2.0 The Cuff of FIGS. 27 to 46

The second component of the tether 14 is the cuff 16, of which there are five embodiments.

2.1 The Cuff of FIGS. 27 to 30

FIGS. 27 to 30 show the first embodiment of the cuff 100. This embodiment has a substantially cylindrical body 102 about 2.8 inches long and about 1.5 inches in diameter at the wide end 104. The diameter remains substantially constant for about 1.38 inches and then decreases at an angle of about 8° from the axis of the body 102 to a diameter of about 1.1 inches at the narrow end 106. The cuff 100 is preferably composed of #1018 cold rolled steel and is chrome plated.

There is an axial bore that runs completely through the body 102. The diameter of the bore at the wide end 108 is substantially constant at about 1.25 inches, and extends for about 1.6 inches into the body 102. The diameter of the bore at the narrow end 110 is substantially constant at about 0.82 inches, and extends for about 1.2 inches into the body 102, creating a shoulder 112 where the discontinuity between the two bores 108, 110 meet.

There is a collar pin hole 114 that extends radially through the wall of the body 102. The pin hole 114 has a diameter of about 0.25 inches and is centered about 0.64 inches from the narrow end 106. There is a U-lock port 116 that extends radially through the wall of the body 102. The port 116 has a diameter of about 0.65 inches and is centered about 0.675 inches from the wide end 104.

Figure 30:
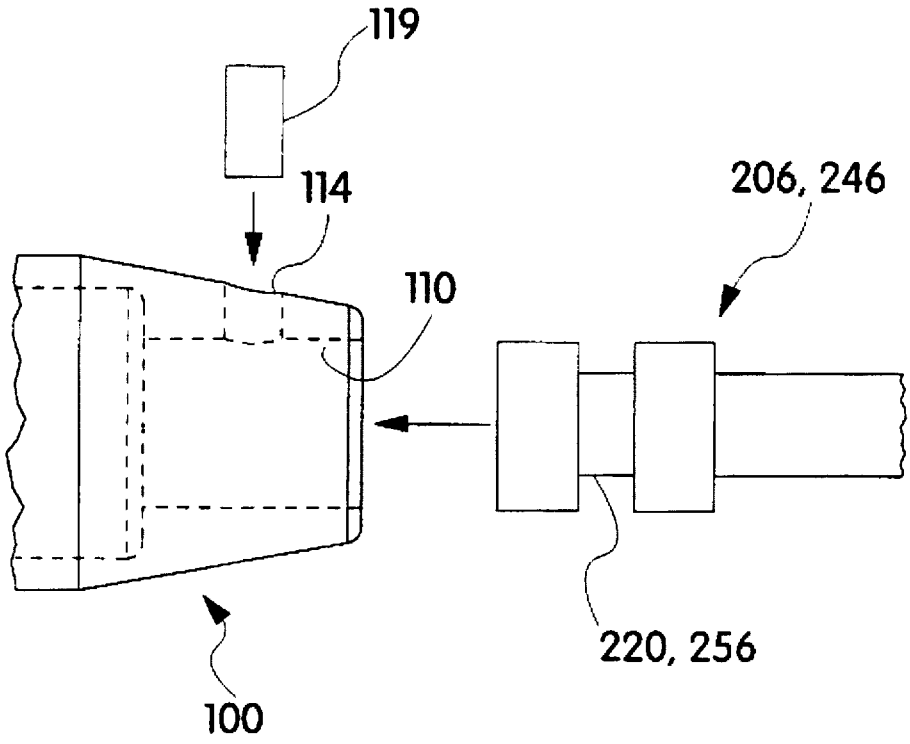
FIG. 30 is an exploded view of the connection between a collar and the cuff of FIG. 30.
Figure 31:
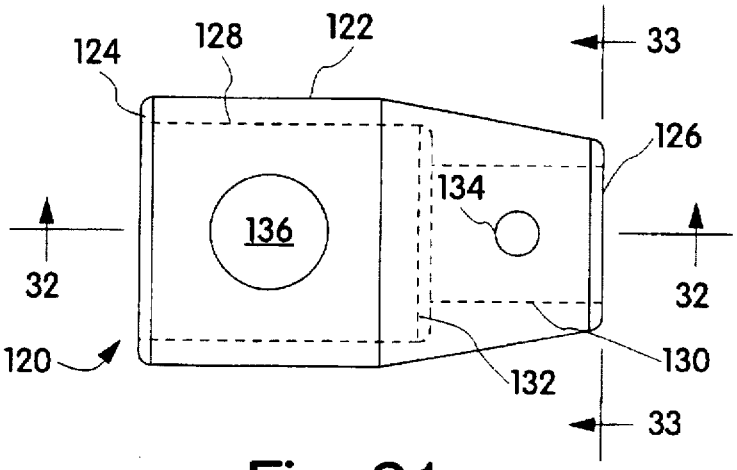
FIG. 31 is a top plan view of the second embodiment of the cuff of the present invention.
Figure 32:
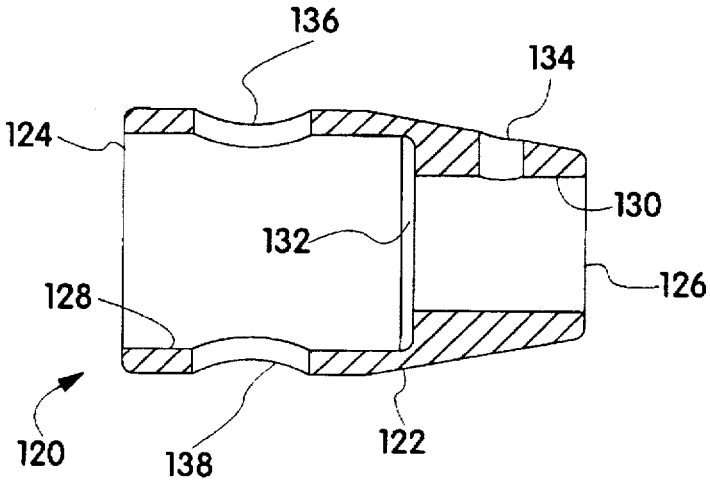
FIG. 32 is a cross-section of the cuff of FIG. 31 taken along the line 32—32.
Figure 33:
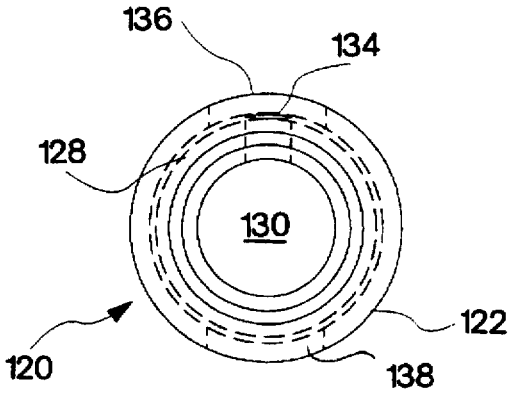
FIG. 33 is a side plan view of the cuff of FIG. 31 taken along the line 33—33.

As shown in FIG. 30, the cuff 100 is attached to the cable 200 or chain 240 by inserting the collar 206, 246 into the narrow end bore 110 until the collar channel 220, 256 is aligned with the collar pin hole 114. A pin 119 is press fitted into the pin hole 114 until it extends into the channel 220, 256. The cable 200 or chain 240 can rotate a full 360° about the cuff 100 but cannot be extracted from the cuff 100.

Figure 47:
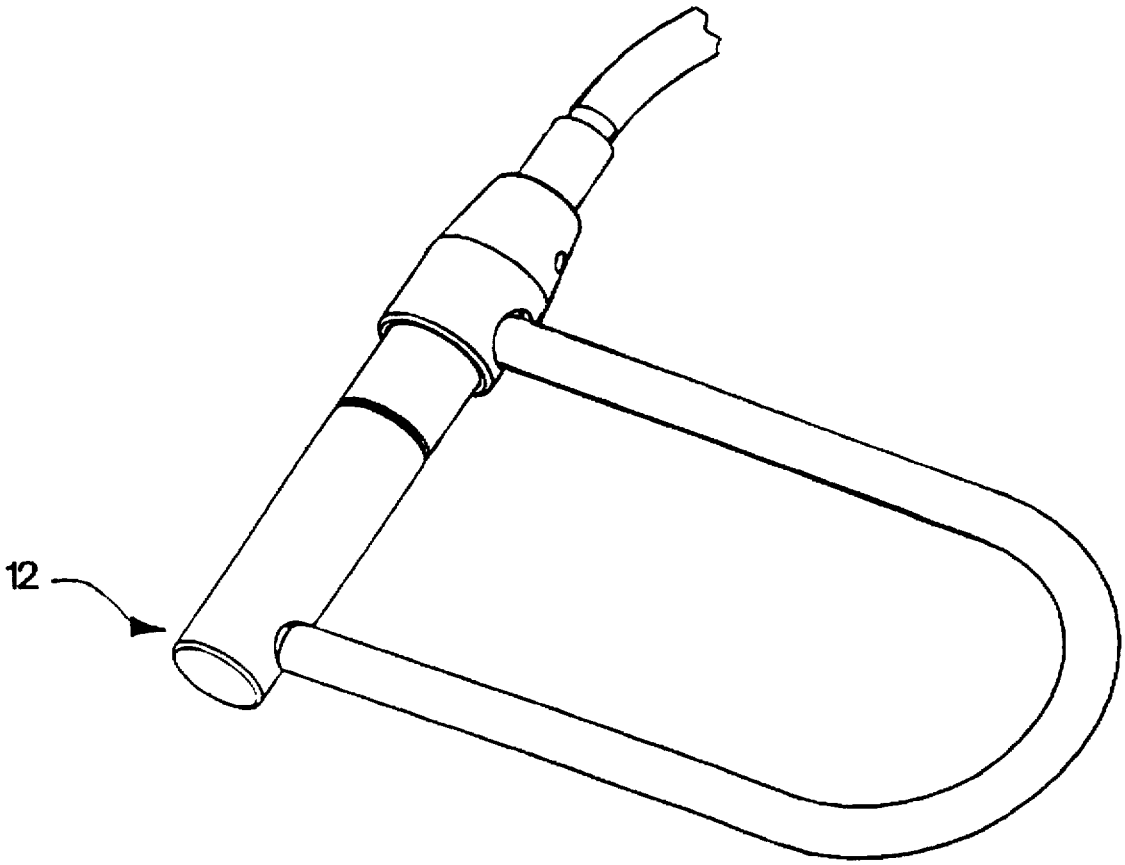
FIG. 47 is a perspective view of a one method of assembling the U-lock to the present invention.

FIG. 47 shows how the assembled harness 10 looks. To assemble the harness 10, first disassemble the U-lock 12. A U-lock with a retainer 54, 58 and end-located security mechanism 26 cannot be used with this cuff 100. If a U-lock with no retainer 54, 58 and with an end-located security mechanism 26 is used, insert the end of the body 20 opposite the security mechanism 26 into the wide end bore 108. If a U-lock with no retainer 54, 58 and with a center-located security mechanism 34 is used, insert either end of the body 20 into the wide end bore 108. If a U-lock with a retainer 54, 58 and center-located security mechanism 34 is used, insert the end of the body 20 closest to the shaped foot opening 24 into the wide end bore 108. After the body 20 is inserted, rotate it until the U-lock port 116 and the appropriate opening 22, 24 are aligned. Then assemble the U-lock 12 normally.

2.2 The Cuff of FIGS. 31 to 34

FIGS. 31 to 34 show the second embodiment of the cuff 120. The cuff 120 has a substantially cylindrical body 122 about 2.8 inches long and about 1.5 inches in diameter at the wide end 124. The diameter remains substantially constant for about 1.38 inches and then decreases at an angle of about 8° from the axis of the body 122 to a diameter of about 1.1 inches at the narrow end 126. The cuff 120 is preferably composed of #1018 cold rolled steel and is chrome plated.

There is an axial bore that runs completely through the body 122. The diameter of the bore at the wide end 128 is substantially constant at about 1.25 inches, and extends for about 1.6 inches into the body 122. The diameter of the bore at the narrow end 130 is substantially constant at about 0.82 inches, and extends for about 1.2 inches into the body 122, creating a shoulder 132 where the discontinuity between the two bores 128, 130 meet.

There is a collar pin hole 134 that extends radially through the wall of the body 122. The pin hole 134 has a diameter of about 0.25 inches and is centered about 0.64 inches from the narrow end 126. There is pair of axially aligned U-lock ports 136, 138 that extend radially through the wall of the body 122. The ports 136, 138 have a diameter of about 0.65 inches and are centered about 0.675 inches from the wide end 124.

Figure 34:
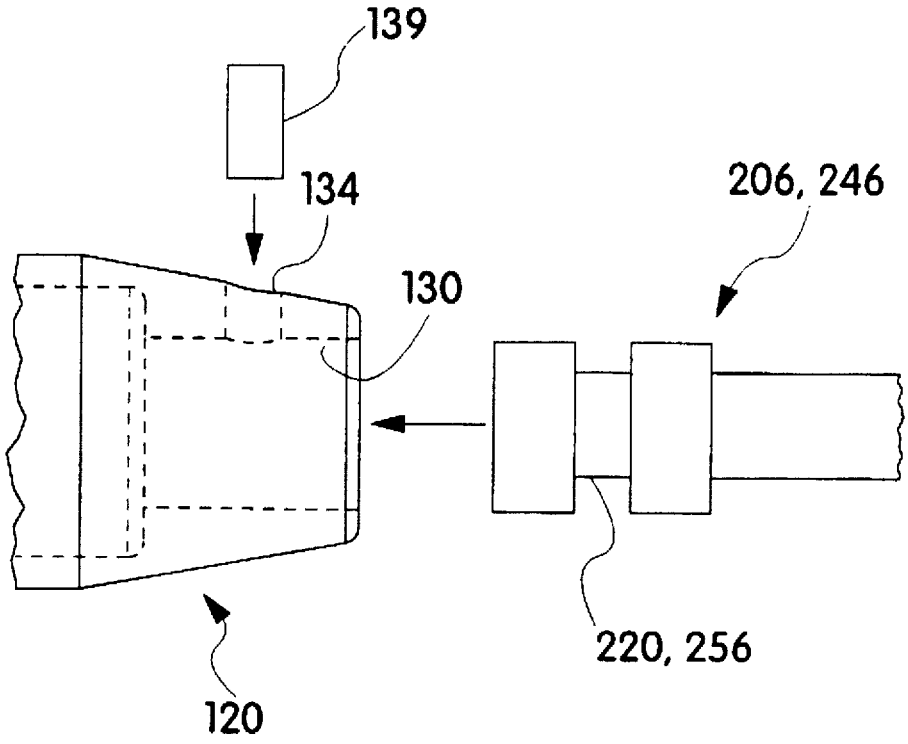
FIG. 34 is an exploded view of the connection between a collar and the cuff of FIG. 31.
Figure 35:
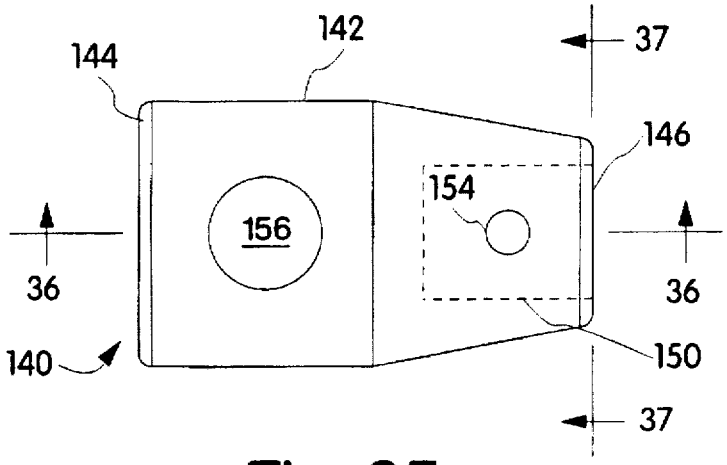
FIG. 35 is a top plan view of the third embodiment of the cuff of the present invention.
Figure 36:
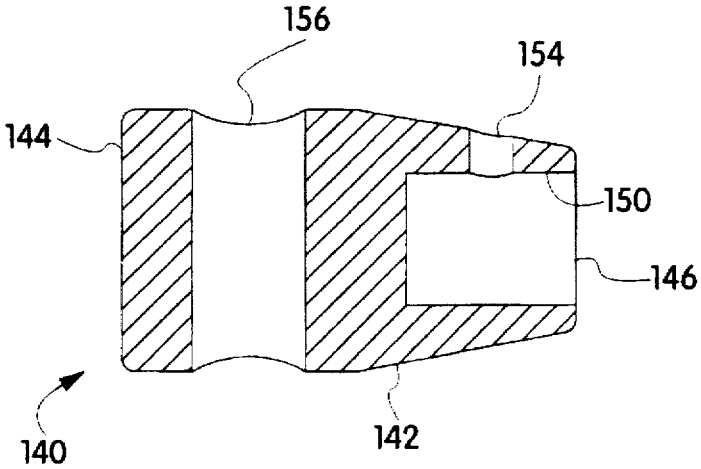
FIG. 36 is a cross-section of the cuff of FIG. 35 taken along the line 36—36.
Figure 37:
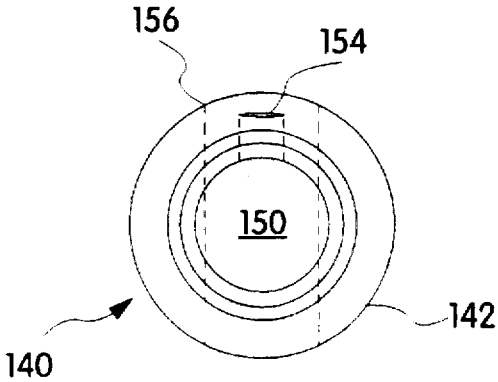
FIG. 37 is a side plan view of the cuff of FIG. 35 taken along the line 37—37.

As shown in FIG. 34, the cuff 120 is attached to the cable 200 or chain 240 by inserting the collar 206, 246 into the narrow end bore 130 until the collar channel 220, 256 is aligned with the line securing hole 134. A pin 139 is press fitted into the pin hole 134 until it extends into the channel 220, 256. The cable 200 or chain 240 can rotate a full 360° about the cuff 120 but cannot be extracted from the cuff 120.

Figure 48:
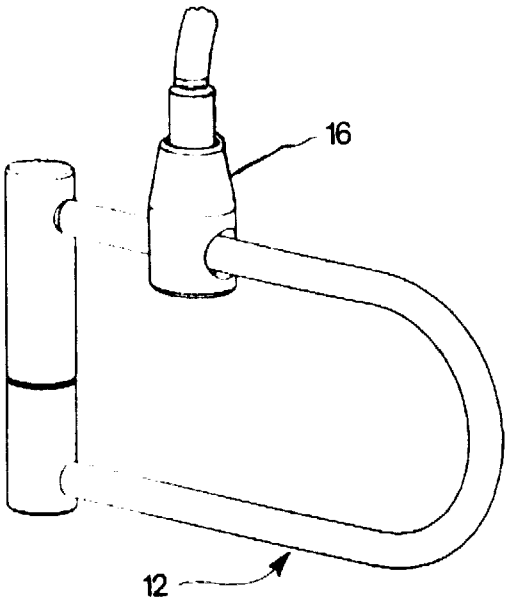
FIG. 48 is a perspective view of a second method of assembling the U-lock to the present invention.

There are two ways to assemble the harness 10, as seen in FIGS. 47 and 48. Both methods begin by first disassembling the U-lock 12. For the first method, any embodiment of U-lock 12 can be used. The U-lock 12 is reassembled normally after inserting one of the shackle legs 42, 44 through the pair of U-lock ports 136, 138. For the second method, a U-lock 12 with a retainer 54, 58 and end-located security mechanism 26 cannot be used. If a U-lock 12 with no retainer 54, 58 and with an end-located security mechanism 26 is used, insert the end of the body 20 opposite the security mechanism 26 into the wide end bore 128. If a U-lock 12 with no retainer 54, 58 and with a center-located security mechanism 34 is used, insert either end of the body 20 into the wide end bore 128. If a U-lock 12 with a retainer 54, 58 and center-located security mechanism 34 is used, insert the end of the body 20 closest to the shaped foot opening 24 into the wide end bore 128. After the body 20 is inserted, rotate it until one of the U-lock ports 136, 138 and the appropriate opening 22, 24 are aligned. Then assemble the U-lock 12 normally.

2.3 The Cuff of FIGS. 35 to 38

FIGS. 35 to 38 show the third embodiment of the cuff 140. The cuff 140 has a substantially solid cylindrical body 142 about 2.8 inches long and about 1.5 inches in diameter at the wide end 144. The diameter remains substantially constant for about 1.38 inches and then decreases at an angle of about 8° from the axis of the body 142 to a diameter of about 1.1 inches at the narrow end 146. The cuff 140 is preferably composed of #1018 cold rolled steel and is chrome plated.

There is an axial bore 150 open at the narrow end 146, the diameter of which is substantially constant at about 0.82 inches, and extends into the body 142 for about 1.2 inches.

There is a collar pin hole 154 that extends radially through the wall of the body 142. The pin hole 154 has a diameter of about 0.25 inches and is centered about 0.64 inches from the narrow end 146. There is a U-lock bore 156 that extends radially through the body 142. The U-lock bore 156 has a diameter of about 0.65 inches and is centered about 0.675 inches from the wide end 144.

Figure 38:
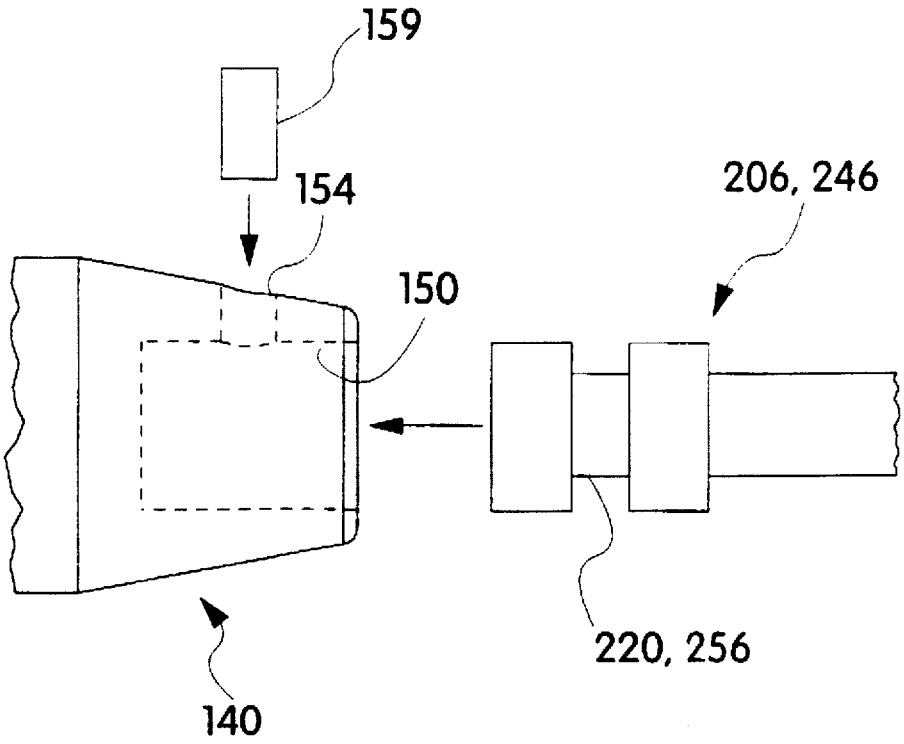
FIG. 38 is an exploded view of the connection between a collar and the cuff of FIG. 35.
Figure 39:
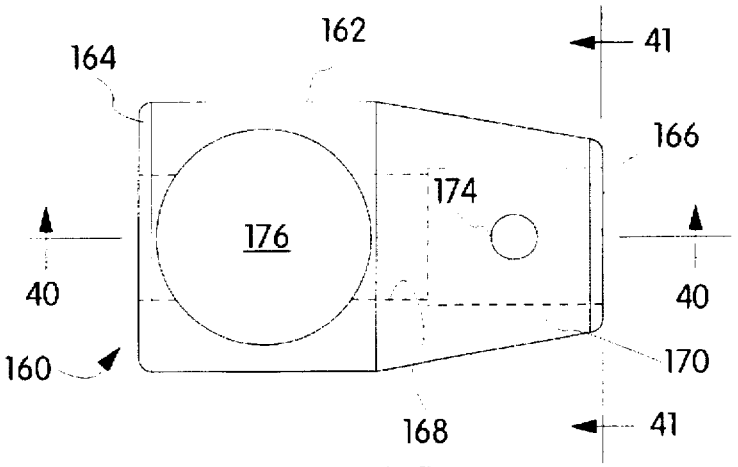
FIG. 39 is a top plan view of the fourth embodiment of the cuff of the present invention.
Figure 40:
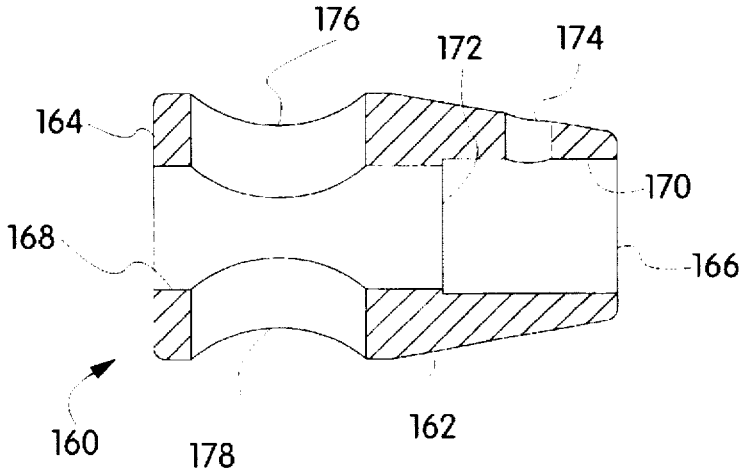
FIG. 40 is a cross-section of the cuff of FIG. 39 taken along the line 40—40.
Figure 41:
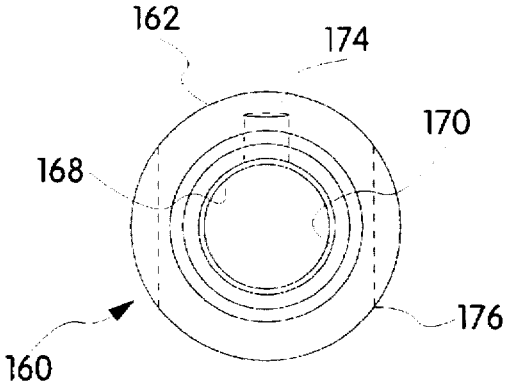
FIG. 41 is a side plan view of the cuff of FIG. 39 taken along the line 41—41.

As shown in FIG. 38, the cuff 140 is attached to the cable 200 or chain 240 by inserting the collar 206, 246 into the narrow end bore 150 until the collar channel 220, 256 is aligned with the pin hole 154. A pin 159 is press fitted into the pin hole 154 until it extends into the channel 220, 256. The cable 200 or chain 240 can rotate a full 360° about the cuff 140 but cannot be extracted from the cuff 140.

FIG. 48 shows how the assembled harness 10 looks. To assemble the harness 10, first disassemble the U-lock 12. The U-lock 12 is reassembled normally after inserting one of the shackle legs 42, 44 through the U-lock bore 156.

2.4 The Cuff of FIGS. 39 to 42

FIGS. 39 to 42 show the fourth embodiment of the cuff 160. The cuff 160 has a substantially cylindrical body 162 about 2.8 inches long and about 1.5 inches in diameter at the wide end 164. The diameter remains substantially constant for about 1.38 inches and then decreases at an angle of about 8° from the axis of the body 162 to a diameter of about 1.1 inches at the narrow end 166. The cuff 160 is preferably composed of #1018 cold rolled steel and is chrome plated.

There is a bore that runs completely through the body 162. The diameter of the bore at the wide end 168 is substantially constant at about 0.8 inches, and extends for about 1.6 inches into the body 162. The diameter of the bore at the narrow end 170 is substantially constant at about 0.8 inches, and extends for about 1.2 inches into the body 162, creating a shoulder 172 where the discontinuity between the two bores 168, 170 meet.

There is a collar pin hole 174 that extends radially through the wall of the body 162. The pin hole 174 has a diameter of about 0.25 inches and is centered about 0.64 inches from the narrow end 166. There is pair of axially aligned U-lock ports 176, 178 that extend radially through the wall of the body 162. The ports 176, 178 have a diameter of about 1.25 inches and are centered about 0.8 inches from the wide end 164.

Figure 42:
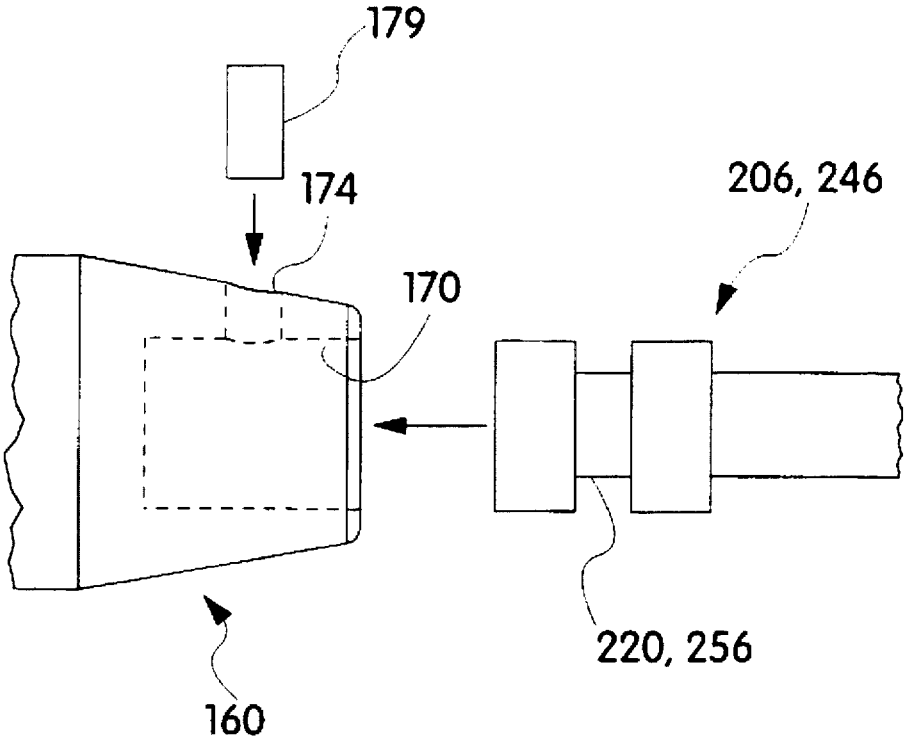
FIG. 42 is an exploded view of the connection between a collar and the cuff of FIG. 39.
Figure 43:
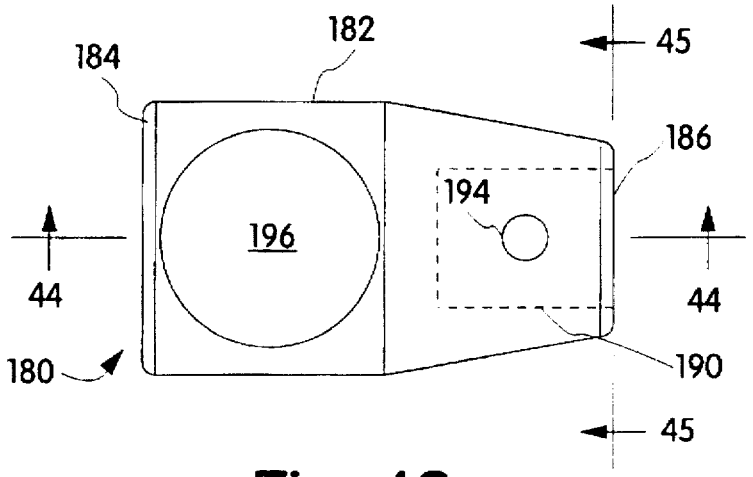
FIG. 43 is a top plan view of the fifth embodiment of the cuff of the present invention.
Figure 44:
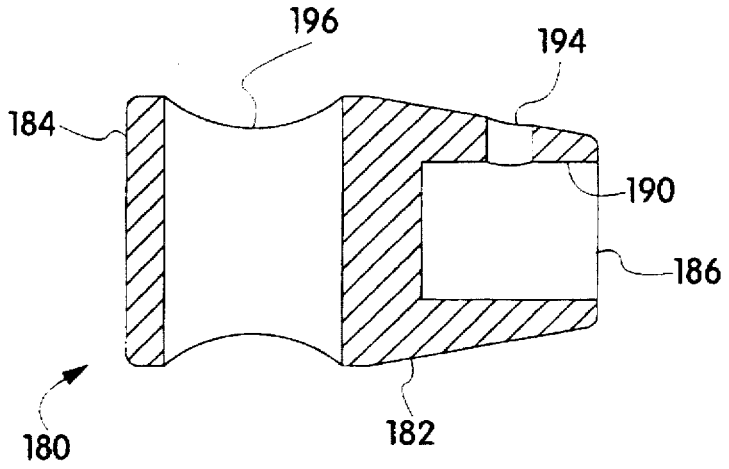
FIG. 44 is a cross-section of the cuff of FIG. 43 taken along the line 44—44.
Figure 45:
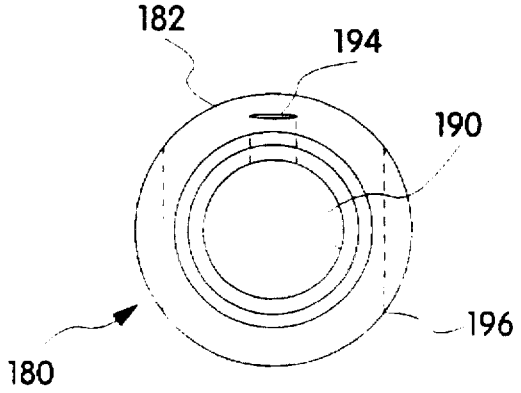
FIG. 45 is a side plan view of the cuff of FIG. 43 taken along the line 45—45.

As shown in FIG. 42, the cuff 160 is attached to the cable 200 or chain 240 by inserting the collar 206, 246 into the narrow end bore 170 until the collar channel 220, 256 is aligned with the pin hole 174. A pin 179 is press fitted into the pin hole 174 until it extends into the channel 220, 256. The cable 200 or chain 240 can rotate a full 360° about the cuff 160 but cannot be extracted from the cuff 160.

Figure 50:
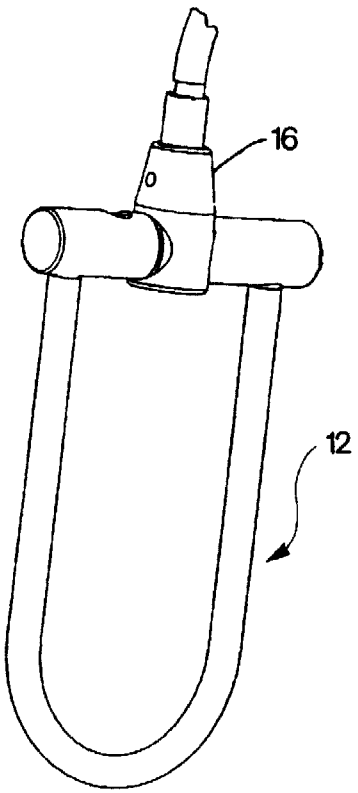
FIG. 50 is a perspective view of a fourth method of assembling the U-lock to the present invention.
Figure 49:
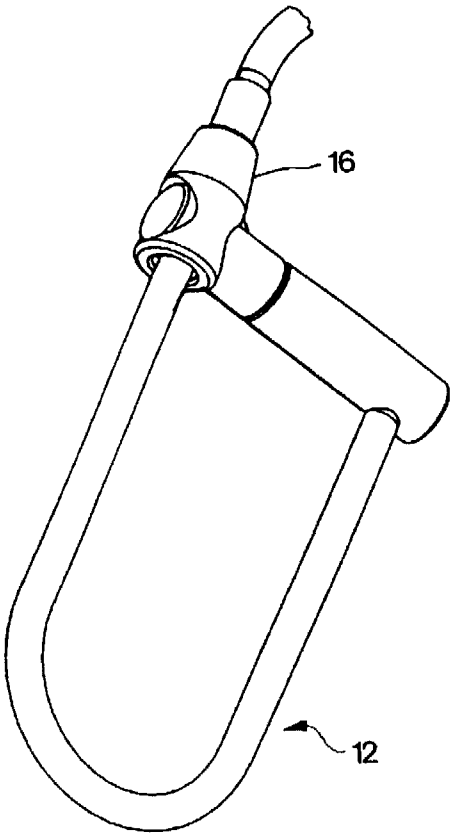
FIG. 49 is a perspective view of a third method of assembling the U-lock to the present invention.

There are two ways to assemble the harness 10, as seen in FIGS. 49 and 50. Both methods begin by first disassembling the U-lock 12. For the first method, any embodiment of U-lock 12 can be used. The U-lock 12 is reassembled normally after inserting the body 20 through the pair of U-lock ports 176, 178. For the second method, if the U-lock does not have retainer 54, 58, insert either end of the body 20 into one of the U-lock ports 176, 178. If the U-lock does have a retainer 54, 58, insert the end of the body 20 closest to the shaped foot opening 24 into one of the U-lock ports 176, 178. After the body 20 is inserted, rotate it until the wide end bore 168 and the appropriate opening 22, 24 are aligned. Then assemble the U-lock 12 normally.

2.5 The Cuff of FIGS. 43 to 46

FIGS. 43 to 46 show the fifth embodiment of the cuff 180. The cuff 180 has a substantially solid cylindrical body 182 about 2.8 inches long and about 1.5 inches in diameter at the wide end 184. The diameter remains substantially constant for about 1.38 inches and then decreases at an angle of about 8° from the axis of the body 182 to a diameter of about 1.1 inches at the narrow end 186. The cuff 180 is preferably composed of #1018 cold rolled steel and is chrome plated.

There is an axial bore 190 open at the narrow end 186, the diameter of which is substantially constant at about 0.82 inches, and extends into the body 182 for about 1.2 inches.

There is a collar pin hole 194 that extends radially through the wall of the body 182. The pin hole 194 has a diameter of about 0.25 inches and is centered about 0.64 inches from the narrow end 186. There is a U-lock bore 196 that extends radially through the body 182. The U-lock bore 196 has a diameter of about 1.25 inches and is centered about 0.8 inches from the wide end 184.

Figure 46:
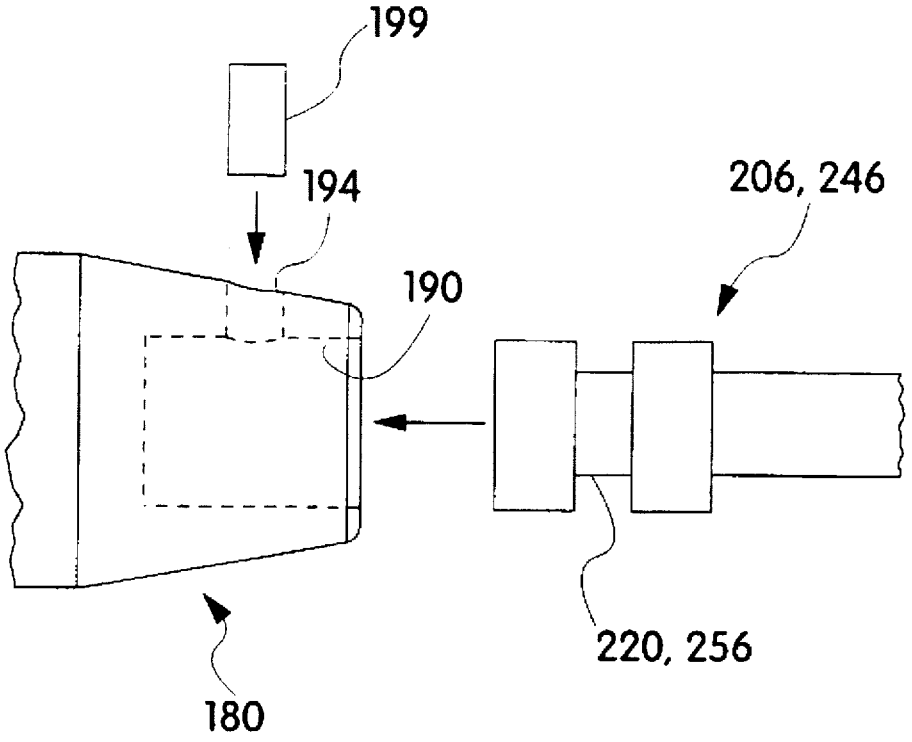
FIG. 46 is an exploded view of the connection between a collar and the cuff of FIG. 43.

As shown in FIG. 46, the cuff 180 is attached to the cable 200 or chain 240 by inserting the collar 206, 246 into the narrow end bore 190 until the collar channel 220, 256 is aligned with the pin hole 194. A pin 199 is press fitted into the pin hole 194 until it extends into the channel 220, 256. The cable 200 or chain 240 can rotate a full 360° about the cuff 180 but cannot be extracted from the cuff 180.

FIG. 50 shows how the assembled harness 10 looks. To assemble the harness 10, first disassemble the U-lock 12. The U-lock 12 is reassembled normally after inserting the body 20 through the U-lock bore 196.

OPERATION

There are two basic ways in which the harness can be used to secure a vehicle. The method chosen can depend on the length of the tether relative to the size of the vehicle and whether any parts of the vehicle are especially valuable or vulnerable to theft.

Figure 51:
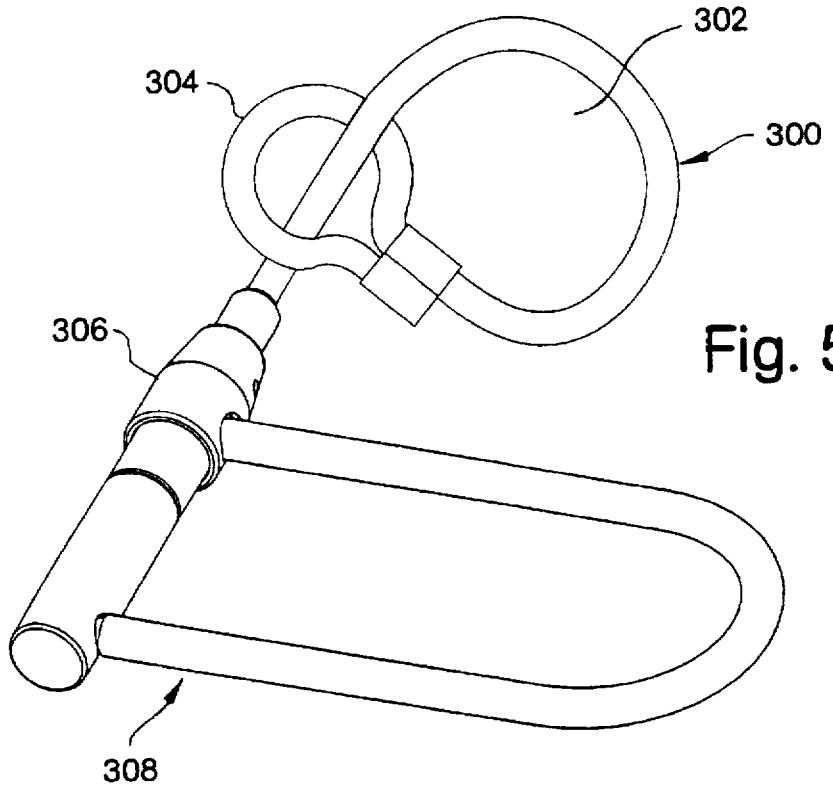
FIG. 51 is a perspective view of a method of using the present invention.

The first method, shown in FIG. 51, could be used if the parts of the vehicle are far apart relative to the length of the tether 300. In essence, the tether 300 is used to create a lasso 302 around one or more parts. For example, if it is desired to secure both wheels of a bicycle, the loop 304 of the tether 300 is inserted through the rear wheel and then the cuff 306 is inserted through the loop 304, creating a lasso 302 around the rear wheel. The U-lock 308 secures the front wheel by assembling it to the cuff 306 and around the wheel and the station.

Figure 52:
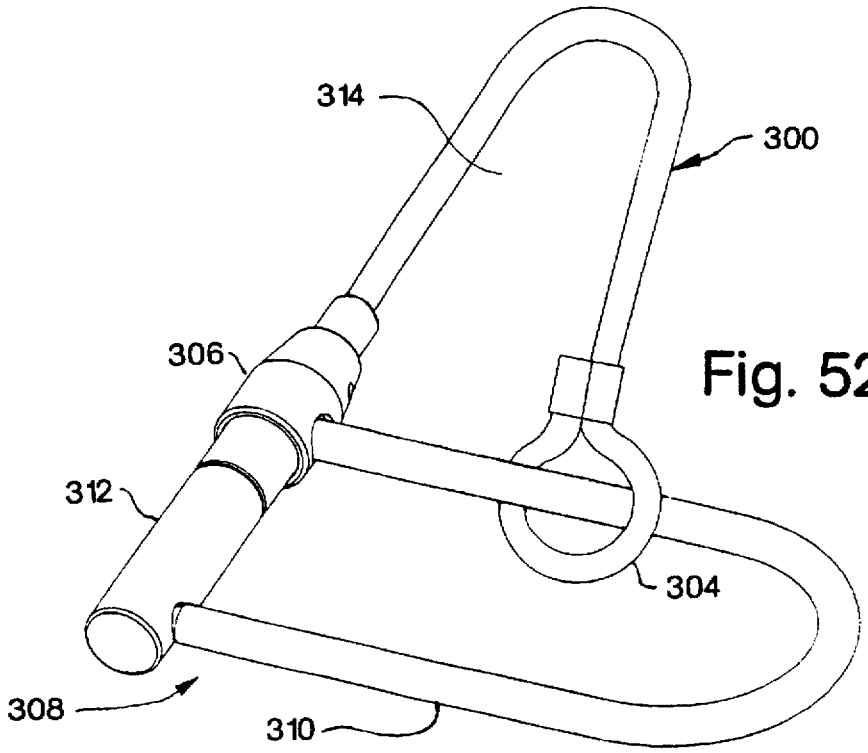
FIG. 52 is a perspective view of another method of using the present invention.

The second method is shown in FIG. 52. The harness is used to create a large ring 314 to encompass all of the vehicle parts to be secured. The tether 300 is snaked through all the parts that the user wishes to secure. Then one component of the U-lock 308, either the shackle 310 or the body 312, is inserted through the loop 304 and the U-lock 308 is assembled to the cuff 306.

What is claimed is:

1. A harness for securing a vehicle to a station, said harness comprising:

(a) a U-lock and a tether;

(b) said U-lock including as components a cross-piece and a shackle;

(c) said cross-piece being tubular and having aligned shackle openings in its wall, where the axes of said shackle openings are substantially parallel;

(d) said shackle having a pair of substantially parallel legs with feet that are adapted to be received simultaneously by said shackle openings;

(e) a lock mechanism in said cross-piece for securing said feet in said shackle openings when received thereby;

(f) said tether including as components a length of elongated flexible aggregation, a loop, and a cuff;

(g) said loop being permanently attached to the first end of said length;

(h) said cuff being permanently attached to the second end of said length by a cuff attaching means;

(i) said cuff providing at least one cuff opening adapted to receive at least one of said components of said U-lock;

(j) said U-lock being free for removal from said cuff when said components of said U-lock are not secured by said lock mechanism, and said U-lock being secured to said cuff when said one of said components of said U-lock is received in said at least one cuff opening and said feet are received in said shackle openings and secured by said lock mechanism;

(k) whereby when said U-lock is secured about at least one of the parts of said vehicle and at least one of the parts of said station, and a noose formed by said loop and another portion of said harness is secured about at least another part of said vehicle, a plurality of said parts are secured to said station when said harness is secured by said lock mechanism.

2. The harness of claim 1 wherein said length is characterized by a steel chain.

3. The harness of claim 1 wherein said length is characterized by a braided cable.

4. The harness of claim 3 wherein said braided cable is composed of a plurality of filaments of materials having high tensile strength and high compression strength.

5. The harness of claim 4 wherein said materials include hardened steel.

6. The harness of claim 3 wherein said loop is defined by said first end of said length being reversely bent to provide a pair of registered segments defining a neck of said loop and a rigid yoke permanently clenching said registered segments together.

7. The harness of claim 1 wherein said length is enveloped by a sheath.

8. The harness of claim 7 wherein said sheath is vinyl.

9. The harness of claim 7 wherein said sheath is a webbing of a material selected from the group consisting of nylon and polypropylene.

10. The harness of claim 1 wherein said loop defines an area larger than said cuff and smaller than the combination of said cuff and said U-lock when said cuff is receiving said U-lock when said feet are received in said shackle openings.

11. The harness of claim 1 wherein said cuff attaching means provides for rotatably attaching said cuff to said length.

12. The harness of claim 11 wherein said cuff attaching means includes a collar permanently attached to said second end of said length and a receptacle in said cuff adapted to permanently retain said collar, said collar being rotatable with respect to said cuff.

13. The harness of claim 1 wherein there is only one opening, said opening being adapted to receive one component of said U-lock.

14. The harness of claim 1 wherein said at least one cuff opening includes a socket and a port, said socket and said port communicating with each other, said socket being adapted to receive one component of said U-lock, and said port being adapted to receive another component of said U-lock.

15. The harness of claim 1 wherein said at least one cuff opening includes a socket and a pair of ports, said socket and said ports communicating with each other, said socket being adapted to receive one component of said U-lock, and said ports being adapted to receive another component of said U-lock.

16. The harness of claim 15 wherein said ports are coaxial.

17. A harness for securing a vehicle to a station, said harness comprising:

(a) a U-lock and a tether;

(b) said U-lock including as components a cross-piece and a shackle;

(c) said cross-piece being tubular and having aligned shackle openings in its wall, where the axes of said shackle openings are substantially parallel;

(d) said shackle having a pair of substantially parallel legs with feet that are adapted to be received simultaneously by said shackle openings;

(e) a lock mechanism in said cross-piece for securing said feet in said shackle openings when received thereby;

(f) said tether including as components a length of braided cable, a loop, and a cuff;

(g) said loop being defined by the first end of said cable being reversely bent to provide a pair of registered segments defining a neck of said loop and a rigid yoke permanently clenching said registered segments together;

(h) said cuff being permanently attached to the second end of said cable by a cuff attaching means;

(i) said cuff attaching means including a collar permanently attached to said second end of said cable and a receptacle in said cuff adapted to permanently retain said collar, said collar being rotatable with respect to said cuff;

(j) said cuff providing at least one cuff opening adapted to receive at least one component of said U-lock;

(k) a sheath enveloping said cable;

(l) said U-lock being secured to said cuff when said one of said components of said U-lock is received in said at least one cuff opening and said feet are received in said shackle openings and secured by said lock mechanism;

(m) whereby when said U-lock is secured about at least one of the parts of said vehicle and at least one of the parts of said station, and a noose formed by said loop and another portion of said harness is secured about at least another part of said vehicle, a plurality of said parts are secured to said station when said harness is secured by said lock mechanism.

18. The harness of claim 17 wherein said braided cable is composed of a plurality of filaments of materials having high tensile strength and high compression strength.

19. The harness of claim 18 wherein said materials include hardened steel.

20. The harness of claim 17 wherein said sheath is vinyl.

21. The harness of claim 17 wherein said sheath is a webbing of a material selected from the group consisting of nylon and polypropylene.

22. The harness of claim 17 wherein said at least one cuff opening includes a socket and a port, said socket and said port communicating with each other, said socket being adapted to receive one component of said U-lock, and said port being adapted to receive another component of said U-lock.

23. The harness of claim 17 wherein said at least one cuff opening includes a socket and a pair of ports, said socket and said ports communicating with each other, said socket being adapted to receive one component of said U-lock, and said ports being axially aligned and adapted to receive another component of said U-lock.

24. A tether for cooperating with a U-lock to secure a vehicle, said U-lock having at least two components, said tether comprising:

(a) a length of braided cable;

(b) a loop defined by the first end of said cable being reversely bent to provide a pair of registered segments defining a neck of said loop and a rigid yoke permanently clenching said registered segments together;

(c) a cuff permanently attached to the second end of said length by a cuff attaching means;

(d) said cuff providing at least one opening adapted to receive at least one component of said U-lock;

(e) said components of said U-lock being adapted to interlock when received by said cuff.

25. The tether of claim 24 wherein said braided cable is composed of a plurality of filaments of materials having high tensile strength and high compression strength.

26. The tether of claim 25 wherein said materials include hardened steel.

27. The tether of claim 24 wherein said length is enveloped by a sheath.

28. The tether of claim 27 wherein said sheath is vinyl.

29. The tether of claim 27 wherein said sheath is a webbing of a material selected from the group consisting of nylon and polypropylene.

30. The tether of claim 24 wherein said loop defines an area larger than said cuff and smaller than the combination of said cuff and said U-lock when said cuff is receiving said U-lock.

31. The tether of claim 24 wherein said cuff attaching means provides for rotatably attaching said cuff to said length.

32. The tether of claim 31 wherein said cuff attaching means includes a collar permanently attached to said second end of said length and a receptacle in said cuff adapted to permanently retain said collar, said collar being rotatable with respect to said cuff.

33. The tether of claim 24 wherein there is only one opening, said opening being adapted to receive one component of said U-lock.

34. The tether of claim 24 wherein said at least one cuff opening includes a socket and a port, said socket and said port communicating with each other, said socket being adapted to receive one component of said U-lock, and said port being adapted to receive another component of said U-lock.

35. The tether of claim 24 wherein said at least one cuff opening includes a socket and a pair of ports, said socket and said ports communicating with each other, said socket being adapted to receive one component of said U-lock, and said ports being adapted to receive another component of said U-lock.

36. The tether of claim 35 wherein said ports are coaxial.

37. A tether for cooperating with a U-lock to secure a vehicle, said U-lock having at least two components, said tether comprising:

(a) a length of braided cable;

(b) a loop defined by the first end of said cable being reversely bent to provide a pair of registered segments defining a neck of said loop and a rigid yoke permanently clenching said registered segments together;

(c) a cuff permanently attached to the second end of said cable by a cuff attaching means;

(d) said cuff attaching means including a collar permanently attached to said second end of said cable and a receptacle in said cuff adapted to permanently retain said collar, said collar being rotatable with respect to said cuff;

(e) said cuff providing at least one opening adapted to receive at least one component of said U-lock;

(f) a sheath enveloping said cable;

(g) said components of said U-lock being adapted to interlock when received by said cuff.

38. The tether of claim 37 wherein said braided cable is composed of a plurality of filaments of materials having high tensile strength and high compression strength.

39. The tether of claim 38 wherein said materials include hardened steel.

40. The tether of claim 37 wherein said sheath is vinyl.

41. The tether of claim 37 wherein said sheath is a webbing of a material selected from the group consisting of nylon and polypropylene.

42. The tether of claim 37 wherein said at least one cuff opening includes a socket and a port, said socket and said port communicating with each other, said socket being adapted to receive one component of said U-lock, and said port being adapted to receive another component of said U-lock.

43. The tether of claim 37 wherein said at least one cuff opening includes a socket and a pair of ports, said socket and said ports communicating with each other, said socket being adapted to receive one component of said U-lock, and said ports being axially aligned and adapted to receive another component of said U-lock.

* * * * *